US009805553B2

(12) United States Patent
Zielinski et al.

(10) Patent No.: US 9,805,553 B2
(45) Date of Patent: Oct. 31, 2017

(54) GAMING SYSTEM AND METHOD PROVIDING ADDITIONAL AWARD OPPORTUNITY BASED ON A PLURALITY OF ACCUMULATED DESIGNATED SYMBOLS

(75) Inventors: John H. Zielinski, Reno, NV (US); Eric D. Fullenwider, Reno, NV (US)

(73) Assignee: IGT, Las Vegas, NV (US)

( * ) Notice: Subject to any disclaimer, the term of this patent is extended or adjusted under 35 U.S.C. 154(b) by 428 days.

(21) Appl. No.: 13/550,159

(22) Filed: Jul. 16, 2012

(65) Prior Publication Data

US 2014/0018146 A1 Jan. 16, 2014

(51) Int. Cl.
*G07F 17/32* (2006.01)

(52) U.S. Cl.
CPC ..... *G07F 17/3267* (2013.01)

(58) Field of Classification Search
CPC .. G07F 17/32; G07F 17/3204; G07F 17/3211; G07F 17/3213; G07F 17/3225; G07F 17/3258; G07F 17/3267; G07F 17/3269; G07F 17/34
USPC ..... 463/20, 16, 25
See application file for complete search history.

(56) References Cited

U.S. PATENT DOCUMENTS 4,198,052 A 4/1980 Gauselmann
4,448,419 A 5/1984 Telnaes
4,618,150 A 10/1986 Kimura
4,624,459 A 11/1986 Kaufman
4,679,143 A 7/1987 Hagiwara
4,695,053 A 9/1987 Vazquez, Jr. et al.
4,711,451 A 12/1987 Pajak et al.
4,732,386 A 3/1988 Rayfiel
(Continued)

FOREIGN PATENT DOCUMENTS

AU 1997 17601 B2 9/1997
EP 0 060 019 9/1982
(Continued)

OTHER PUBLICATIONS

Slot Machines on Parade, Robert N. Geddes and Daniel R. Mead (3 pages).

*Primary Examiner* — Milap Shah
*Assistant Examiner* — Jeffrey Wong
(74) *Attorney, Agent, or Firm* — Neal, Gerber & Eisenberg LLP

(57) ABSTRACT

Various embodiments of the present disclosure are directed to a gaming system and method providing an additional award opportunity based on a plurality of accumulated designated symbols. In one embodiment, for each play of a game associated with a plurality of symbols including a designated symbol, the gaming system displays a plurality of the symbols at a plurality of symbol display areas, determines any awards associated with the displayed symbols, and provides any determined awards. Upon an occurrence of a designated symbol accumulation event, the gaming system displays the designated symbol at a designated symbol accumulation area. The gaming system removes the accumulated designated symbol from the designated symbol accumulation area following an expiration event. Upon an occurrence of an additional award opportunity triggering event associated with any accumulated designated symbols displayed at the designated symbol accumulation area, the gaming system provides an additional award opportunity.

18 Claims, 15 Drawing Sheets

(56) References Cited

U.S. PATENT DOCUMENTS 4,756,531 A 7/1988 DiRe et al.
4,837,728 A 6/1989 Barrie et al.
4,838,552 A 6/1989 Hagiwara
4,991,848 A 2/1991 Greenwood et al.
5,019,973 A 5/1991 Wilcox et al.
5,085,436 A 2/1992 Bennett
5,205,555 A 4/1993 Hamano
5,209,479 A 5/1993 Nagao et al.
5,344,144 A 9/1994 Canon
5,393,057 A 2/1995 Marnell, II
5,393,061 A 2/1995 Manship et al.
5,395,111 A 3/1995 Inoue
5,431,408 A 7/1995 Adams
5,449,173 A 9/1995 Thomas et al.
5,456,465 A 10/1995 Durham
5,580,053 A 12/1996 Crouch
5,580,055 A 12/1996 Hagiwara
5,584,764 A 12/1996 Inoue
5,609,524 A 3/1997 Inoue
5,611,535 A 3/1997 Tiberio
5,655,961 A 8/1997 Acres et al.
5,664,998 A 9/1997 Seelig et al.
5,722,891 A 3/1998 Inoue
5,752,881 A 5/1998 Inoue
5,769,716 A 6/1998 Saffari et al.
5,772,509 A 6/1998 Weiss
5,788,573 A 8/1998 Baerlocher et al.
5,807,172 A 9/1998 Piechowiak
5,823,874 A 10/1998 Adams
5,833,536 A 11/1998 Davids et al.
5,833,537 A 11/1998 Barrie
5,848,932 A 12/1998 Adams
5,851,148 A 12/1998 Brune et al.
5,863,249 A 1/1999 Inoue
5,882,261 A 3/1999 Adams
5,890,962 A 4/1999 Takemoto
5,902,184 A 5/1999 Bennett et al.
5,919,088 A 7/1999 Weiss
5,927,714 A 7/1999 Kaplan
5,947,820 A 9/1999 Morro et al.
5,951,397 A 9/1999 Dickinson
5,980,384 A 11/1999 Barrie
5,984,781 A 11/1999 Sunaga
5,984,782 A 11/1999 Inoue
5,997,401 A 12/1999 Crawford
6,004,207 A 12/1999 Wilson, Jr. et al.
6,012,982 A 1/2000 Piechowiak et al.
6,015,346 A 1/2000 Bennett
6,027,115 A 2/2000 Griswold et al.
6,033,307 A 3/2000 Vancura
6,053,813 A 4/2000 Mathis
6,056,642 A 5/2000 Bennett
6,059,289 A 5/2000 Vancura
6,062,980 A 5/2000 Luciano
6,089,976 A 7/2000 Schneider et al.
6,089,977 A 7/2000 Bennett
6,093,102 A 7/2000 Bennett
6,095,921 A 8/2000 Walker et al.
6,102,798 A 8/2000 Bennett
6,113,098 A 9/2000 Adams
6,120,031 A 9/2000 Adams
6,120,377 A 9/2000 McGinnis, Sr. et al.
6,120,378 A 9/2000 Moody et al.
6,126,542 A 10/2000 Fier
6,135,844 A 10/2000 D'Andrea
6,135,884 A 10/2000 Hedrick et al.
6,146,273 A 11/2000 Olsen
6,155,925 A 12/2000 Giobbi et al.
6,159,095 A 12/2000 Frohm et al.
6,159,097 A 12/2000 Gura
6,159,098 A 12/2000 Slomiany et al.
6,165,070 A 12/2000 Nolte et al.
6,168,520 B1 1/2001 Baerlocher et al.
6,168,523 B1 1/2001 Piechowiak et al.
6,174,233 B1 1/2001 Sunaga et al.
6,186,894 B1 2/2001 Mayeroff
6,190,254 B1 2/2001 Bennett
6,190,255 B1 2/2001 Thomas et al.
6,200,217 B1 3/2001 Osawa
6,203,429 B1 3/2001 Demar et al.
6,203,430 B1 3/2001 Walker et al.
6,220,959 B1 4/2001 Holmes, Jr. et al.
6,224,483 B1 5/2001 Mayeroff
6,227,971 B1 5/2001 Weiss
6,231,442 B1 5/2001 Mayeroff
6,231,445 B1 5/2001 Acres
6,234,897 B1 5/2001 Frohm et al.
6,238,287 B1 5/2001 Komori et al.
6,241,607 B1 6/2001 Payne et al.
6,251,013 B1 6/2001 Bennett
6,254,483 B1 7/2001 Acres
6,261,177 B1 7/2001 Bennett
6,261,178 B1 7/2001 Bennett
6,270,411 B1 8/2001 Gura et al.
6,270,412 B1 8/2001 Crawford et al.
6,299,165 B1 10/2001 Nagano
6,309,299 B1 10/2001 Weiss
6,309,300 B1 10/2001 Glavich
6,311,976 B1 11/2001 Yoseloff et al.
6,312,334 B1 11/2001 Yoseloff
6,315,660 B1 11/2001 DeMar et al.
6,315,664 B1 11/2001 Baerlocher et al.
6,315,666 B1 11/2001 Mastera et al.
6,319,124 B1 11/2001 Baerlocher et al.
6,328,649 B1 12/2001 Randall et al.
6,336,860 B1 1/2002 Webb
6,346,043 B1 2/2002 Colin et al.
6,347,996 B1 2/2002 Gilmore et al.
6,358,147 B1 3/2002 Jaffe et al.
6,364,314 B1 4/2002 Canterbury
6,364,766 B1 4/2002 Anderson et al.
6,364,768 B1 4/2002 Acres et al.
6,368,216 B1 4/2002 Hedrick et al.
6,375,567 B1 4/2002 Acres
6,398,218 B1 6/2002 Vancura
6,413,162 B1 7/2002 Baerlocher et al.
6,419,579 B1 7/2002 Bennett
6,439,993 B1 8/2002 O'Halloran
6,461,241 B1 10/2002 Webb et al.
6,464,581 B1 10/2002 Yoseloff et al.
6,477,251 B1 11/2002 Szrek et al.
6,491,584 B2 12/2002 Graham et al.
6,494,454 B2 12/2002 Adams
6,517,432 B1 2/2003 Jaffe
6,533,658 B1 3/2003 Walker et al.
6,547,242 B1 4/2003 Sugiyama et al.
6,551,187 B1 4/2003 Jaffe
6,558,254 B2 5/2003 Baelocher et al.
6,561,900 B1 5/2003 Baerlocher et al.
6,561,904 B2 5/2003 Locke et al.
6,585,591 B1 7/2003 Baerlocher et al.
6,599,193 B2 7/2003 Baerlocher et al.
6,602,137 B2 8/2003 Kaminkow et al.
6,604,999 B2 8/2003 Ainsworth
6,605,002 B2 8/2003 Baerlocher
6,609,971 B2 8/2003 Vancura
6,612,575 B1 9/2003 Cole et al.
6,616,142 B2 9/2003 Adams
6,676,511 B2 1/2004 Payne et al.
6,712,693 B1 3/2004 Hettinger
6,715,756 B2 4/2004 Inoue
6,726,563 B1 4/2004 Baerlocher et al.
6,739,971 B2 5/2004 Devaull
6,835,133 B2 12/2004 Baerlocher et al.
6,857,958 B2 2/2005 Osawa
6,866,583 B2 3/2005 Glavich et al.
6,910,962 B2 6/2005 Marks et al.
6,913,532 B2 7/2005 Baerlocher et al.
6,935,950 B2 8/2005 Tarantino
6,942,567 B2 9/2005 Baerlocher et al.
6,955,600 B2 10/2005 Glavich et al.
6,960,133 B1 11/2005 Marks et al.
7,011,581 B2 3/2006 Cole et al.
7,029,395 B1 4/2006 Baerlocher

(56) References Cited

U.S. PATENT DOCUMENTS 7,070,501 B2 7/2006 Cormack et al.
7,070,502 B1 7/2006 Bussick et al.
7,223,172 B2 5/2007 Baerlocher et al.
7,238,110 B2 7/2007 Glavich et al.
7,300,351 B2 11/2007 Thomas
7,322,887 B2 1/2008 Belger et al.
7,326,115 B2 2/2008 Baerlocher
7,331,867 B2 2/2008 Baerlocher et al.
7,371,171 B1 5/2008 Englman et al.
7,371,172 B2 5/2008 Inoue
7,419,162 B2 9/2008 Lancaster et al.
7,455,585 B2 11/2008 Englman
7,473,174 B2 1/2009 Cuddy et al.
7,494,413 B2 2/2009 Singer et al.
7,507,155 B2 3/2009 Mead et al.
7,513,828 B2 4/2009 Nguyen et al.
7,572,183 B2 8/2009 Olivas et al.
7,585,221 B2 9/2009 Singer et al.
7,591,724 B2 9/2009 Baerlocher
7,614,952 B2 11/2009 Elias
7,666,085 B2 2/2010 Vorias
7,753,769 B2 7/2010 Gomez et al.
7,775,877 B2 8/2010 Baerlocher et al.
7,785,196 B2 8/2010 Baerlocher et al.
7,789,747 B2 9/2010 Glavich et al.
7,927,206 B2 4/2011 Baerlocher et al.
2001/0048193 A1 12/2001 Yoseloff et al.
2001/0054794 A1 12/2001 Cole et al.
2002/0025844 A1 2/2002 Casey et al.
2002/0025845 A1 2/2002 Cannon
2002/0026923 A1 3/2002 Bertsch et al.
2002/0055382 A1 5/2002 Meyer
2002/0094857 A1 7/2002 Meyer
2003/0013518 A1 1/2003 Graham
2003/0027625 A1 2/2003 Rowe
2003/0045345 A1 3/2003 Berman
2003/0054875 A1 3/2003 Marks et al.
2003/0092480 A1 5/2003 White et al.
2003/0114215 A1 6/2003 Adams et al.
2003/0216165 A1 11/2003 Singer et al.
2004/0009803 A1 1/2004 Bennett et al.
2004/0023714 A1 2/2004 Asdale
2004/0048646 A1 3/2004 Visocnik
2004/0053662 A1 3/2004 Pacey
2004/0166918 A1* 8/2004 Walker ..... G07F 17/323 463/16
2004/0195773 A1 10/2004 Masci et al.
2004/0242313 A1 12/2004 Munoz
2004/0242314 A1 12/2004 Casey
2005/0054421 A1 3/2005 Hughs-Baird et al.
2005/0059478 A1 3/2005 Peterson et al.
2005/0075157 A1 4/2005 Seelig et al.
2005/0096121 A1 5/2005 Gilliland et al.
2005/0130733 A1 6/2005 Mierau et al.
2005/0153770 A1 7/2005 Vancura
2005/0170876 A1 8/2005 Masci et al.
2005/0192081 A1 9/2005 Marks et al.
2006/0019738 A1 1/2006 Baerlocher et al.
2006/0040728 A1 2/2006 Fuller
2006/0058097 A1 3/2006 Berman et al.
2006/0068881 A1 3/2006 Casey
2006/0068893 A1 3/2006 Jaffe et al.
2006/0073872 A1 4/2006 B-Jensen et al.
2006/0079317 A1 4/2006 Flemming et al.
2006/0135238 A1 6/2006 Lancaster et al.
2006/0160609 A1 7/2006 Dicarlo
2006/0189377 A1 8/2006 Gomez et al.
2007/0026923 A1 2/2007 Muir
2007/0060246 A1 3/2007 Baerlocher et al.
2007/0060255 A1 3/2007 Baerlocher et al.
2007/0060297 A1 3/2007 Hein et al.
2007/0117610 A1 5/2007 Webb et al.
2007/0167223 A1 7/2007 Bleich et al.
2007/0259713 A1 11/2007 Fiden et al.
2008/0020815 A1 1/2008 Lancaster et al.
2008/0045302 A1 2/2008 Low
2008/0070675 A1 3/2008 Ganger
2008/0076500 A1 3/2008 Lancaster et al.
2008/0108408 A1 5/2008 Wolf
2008/0132320 A1 6/2008 Rodgers
2009/0011822 A1 1/2009 Englman et al.
2009/0011823 A1 1/2009 Englman et al.
2009/0011824 A1 1/2009 Englman et al.
2009/0069068 A1 3/2009 Cole et al.
2009/0075722 A1* 3/2009 Louie et al. ..... 463/20
2009/0082087 A1 3/2009 Pacey et al.
2009/0104977 A1* 4/2009 Zielinski ..... 463/25
2009/0117979 A1* 5/2009 Decasa, Jr. ..... G07F 17/32 463/20
2009/0117989 A1 5/2009 Arezina et al.
2009/0124332 A1 5/2009 Baerlocher
2009/0124346 A1 5/2009 Baerlocher
2009/0124362 A1 5/2009 Cuddy et al.
2009/0233683 A1 9/2009 Kim
2010/0004049 A1 1/2010 Ching et al.
2010/0016071 A1 1/2010 Jaffe et al.
2010/0029363 A1 2/2010 Hoffman et al.
2010/0124973 A1 5/2010 DeWaal et al.
2010/0285864 A1 11/2010 Baerlocher et al.
2011/0021266 A1 1/2011 Jaffe et al.
2011/0117989 A1 5/2011 Kennedy et al.
2011/0124395 A1 5/2011 Baerlocher et al.
2012/0244928 A1* 9/2012 Visser ..... G07F 17/3225 463/21

FOREIGN PATENT DOCUMENTS

EP 0 238 289 A3 9/1987
EP 0 410 789 A2 7/1990
EP 0 945 837 A2 9/1999
EP 0 984 408 A2 3/2000
EP 1 205 984 A2 10/2001
EP 1 298 606 4/2003
EP 1 184 822 A3 6/2003
EP 1 396 829 3/2004
GB 2 226 907 7/1990
GB 2 242 300 9/1991
GB 2 328 311 A 2/1999
GB 2 170 636 3/2004
WO WO 00/66235 11/2000
WO WO 00/76606 A1 12/2000
WO WO 01/19476 3/2001
WO WO 01/87441 11/2001
WO WO 02/17250 2/2002
WO WO 03/049055 A2 3/2003
WO WO 03/026758 4/2003

* cited by examiner

GAMING SYSTEM AND METHOD PROVIDING ADDITIONAL AWARD OPPORTUNITY BASED ON A PLURALITY OF ACCUMULATED DESIGNATED SYMBOLS

COPYRIGHT NOTICE

A portion of the disclosure of this patent document contains or may contain material that is subject to copyright protection. The copyright owner has no objection to the photocopy reproduction by anyone of the patent document or the patent disclosure in exactly the form it appears in the Patent and Trademark Office patent the or records, but otherwise reserves all copyright rights whatsoever.

BACKGROUND

Gaming machines that provide players awards in primary or base games are well known. These gaming machines generally require a player to place a wager to activate a play of the primary game. For many of these gaming machines, any award provided to a player for a wagered-on play of a primary game is based on the player obtaining a winning symbol or a winning symbol combination and on an amount of the wager (e.g., the higher the amount of the wager, the higher the award). Winning symbols or winning symbol combinations that are less likely to occur typically result in higher awards being provided when they do occur.

For such known gaming machines, an amount of a wager placed on a primary game by a player may vary. For instance, a gaming machine may enable a player to wager a minimum quantity of credits, such as one credit (e.g., one cent, nickel, dime, quarter, or dollar), up to a maximum quantity of credits, such as five credits. The gaming machine may enable the player to place this wager a single time or multiple times for a single play of the primary game. For instance, a gaming machine configured to operate a slot game may have one or more paylines, and the gaming machine may enable a player to place a wager on each of the paylines for a single play of the slot game. Thus, it is known that a gaming machine, such as one configured to operate a slot game, may enable players to place wagers of substantially different amounts on each play of a primary game. For example, the amounts of the wagers may range from one credit up to 125 credits (e.g., five credits on each of twenty-five separate paylines). This is also true for other wagering games, such as video draw poker, in which players can place wagers of one or more credits on each hand, and in which multiple hands can be played simultaneously. Accordingly, it should be appreciated that different players play at substantially different wager amounts or levels and substantially different rates of play.

Bonus or secondary games are also known in gaming machines. Such gaming machines usually provide an award to a player for a play of one such bonus game in addition to any awards provided for any plays of any primary games. Bonus games usually do not require an additional wager to be placed by the player to be initiated. Bonus games are typically initiated or triggered upon an occurrence of a designated triggering symbol or designated triggering symbol combination in the primary game. For instance, a gaming machine may initiate or trigger a bonus game when a bonus symbol occurs on the payline on the third reel of a three reel slot machine. The gaming machine generally indicates when a bonus game is initiated or triggered through one or more visual and/or audio output devices, such as the reels, lights, speakers, display screens, etc. Part of the enjoyment and excitement of playing certain gaming machines is the initiation or triggering of a bonus game, even before the player knows an amount of a bonus award won via the bonus game.

Certain known gaming machines randomly initiate or trigger such bonus games during play of the primary game. That is, such known gaming machines initiate or trigger such bonus games for no discernable or understandable reason from the player's perspective. As a result, for some players, player enjoyment and excitement is not fully maximized because the player has nothing to "root for" during play of the primary game other than a randomly occurring bonus triggering symbol, randomly occurring bonus triggering symbol combination, or other bonus triggering event. Accordingly, there is a need to provide a player with an additional award opportunity, such as a play of a bonus game, upon an occurrence of one or more easily discernable or understandable events to increase player involvement, enjoyment, and excitement.

SUMMARY

Various embodiments of the present disclosure are directed to a gaming system and method providing an additional award opportunity based on a plurality of accumulated designated symbols. In operation of certain embodiments, for each play of a game associated with a plurality of symbols including a designated symbol, the gaming system displays a plurality of the symbols at a plurality of symbol display areas, determines any awards associated with the displayed symbols, and provides any determined awards. Upon an occurrence of a designated symbol accumulation event, the gaming system displays the designated symbol at a designated symbol accumulation area (i.e., accumulates the designated symbol). The gaming system removes the accumulated designated symbol from the designated symbol accumulation area following an expiration event such as an expiration of a designated period associated with that accumulated designated symbol. Put differently, following the occurrence of the designated symbol accumulation event in one embodiment, the gaming system displays the designated symbol at the designated symbol accumulation area (i.e., accumulates the designated symbol), monitors whether the designated period associated with that accumulated designated symbol has expired, and removes that accumulated designated symbol from the designated symbol accumulation area following the expiration of the designated period (i.e., following the expiration event). Upon an occurrence of an additional award opportunity triggering event associated with any accumulated designated symbols displayed at the designated symbol accumulation area, the gaming system provides an additional award opportunity.

In one embodiment, the designated symbol accumulation event occurs when the designated symbol is generated and displayed at one of the symbol display areas for a play of the game, the expiration event occurs following an expiration of a designated period that is a designated quantity of consecutive plays of the game, and the additional award opportunity triggering event occurs when at least three accumulated designated symbols are simultaneously displayed at the designated symbol accumulation area for a play of the game. Thus, in this embodiment, when the designated symbol is generated and displayed at one of the symbol display areas for a play of the game, the gaming system displays the designated symbol at the designated symbol accumulation area (i.e., accumulates the designated symbol) and continues displaying the accumulated designated symbol at the designated symbol accumulation area for each of the designated quantity of consecutive plays of the game. Additionally, for a play of the game in this embodiment, when at least three accumulated designated symbols are displayed at the designated symbol accumulation area, the gaming system provides an additional award opportunity. Further, in this embodiment, the designated periods associated with at least two accumulated designated symbols expire at different times.

Thus, in various embodiments, the gaming system of the present disclosure is configured to provide a player with an additional award opportunity upon an occurrence of an easily discernable or understandable event: at least a designated quantity of accumulated designated symbols being displayed at a designated symbol accumulation area. This provides the player with something additional to "root for" during play of the game, thereby increasing player involvement, enjoyment, and excitement.

Additional features and advantages are described herein, and will be apparent from, the following Detailed Description and the Figures.

DETAILED DESCRIPTION

Providing an Additional Award Opportunity Based on a Plurality of Accumulated Designated Symbols Various embodiments of the present disclosure are directed to a gaming system and method providing an additional award opportunity based on a plurality of accumulated designated symbols. In operation of certain embodiments, for each play of a game associated with a plurality of symbols including a designated symbol, the gaming system displays a plurality of the symbols at a plurality of symbol display areas, determines any awards associated with the displayed symbols, and provides any determined awards. Upon an occurrence of a designated symbol accumulation event, the gaming system displays the designated symbol at a designated symbol accumulation area (i.e., accumulates the designated symbol). The gaming system removes the accumulated designated symbol from the designated symbol accumulation area following an expiration event such as an expiration of a designated period associated with that accumulated designated symbol. Put differently, following the occurrence of the designated symbol accumulation event in one embodiment, the gaming system displays the designated symbol at the designated symbol accumulation area (i.e., accumulates the designated symbol), monitors whether the designated period associated with that accumulated designated symbol has expired, and removes that accumulated designated symbol from the designated symbol accumulation area following the expiration of the designated period (i.e., following the expiration event). Upon an occurrence of an additional award opportunity triggering event associated with any accumulated designated symbols displayed at the designated symbol accumulation area, the gaming system provides an additional award opportunity.

While the embodiments described below are directed to a primary wagering game, it should be appreciated that the present disclosure may additionally or alternatively be employed in association with a secondary or bonus game. Moreover, while the player's credit balance, the player's wager, and any awards are displayed as an amount of monetary credits or currency in the embodiments described below, one or more of such player's credit balance, such player's wager, and any awards provided to such player may be for non-monetary credits, promotional credits, and/or player tracking points or credits.

Figure 1:
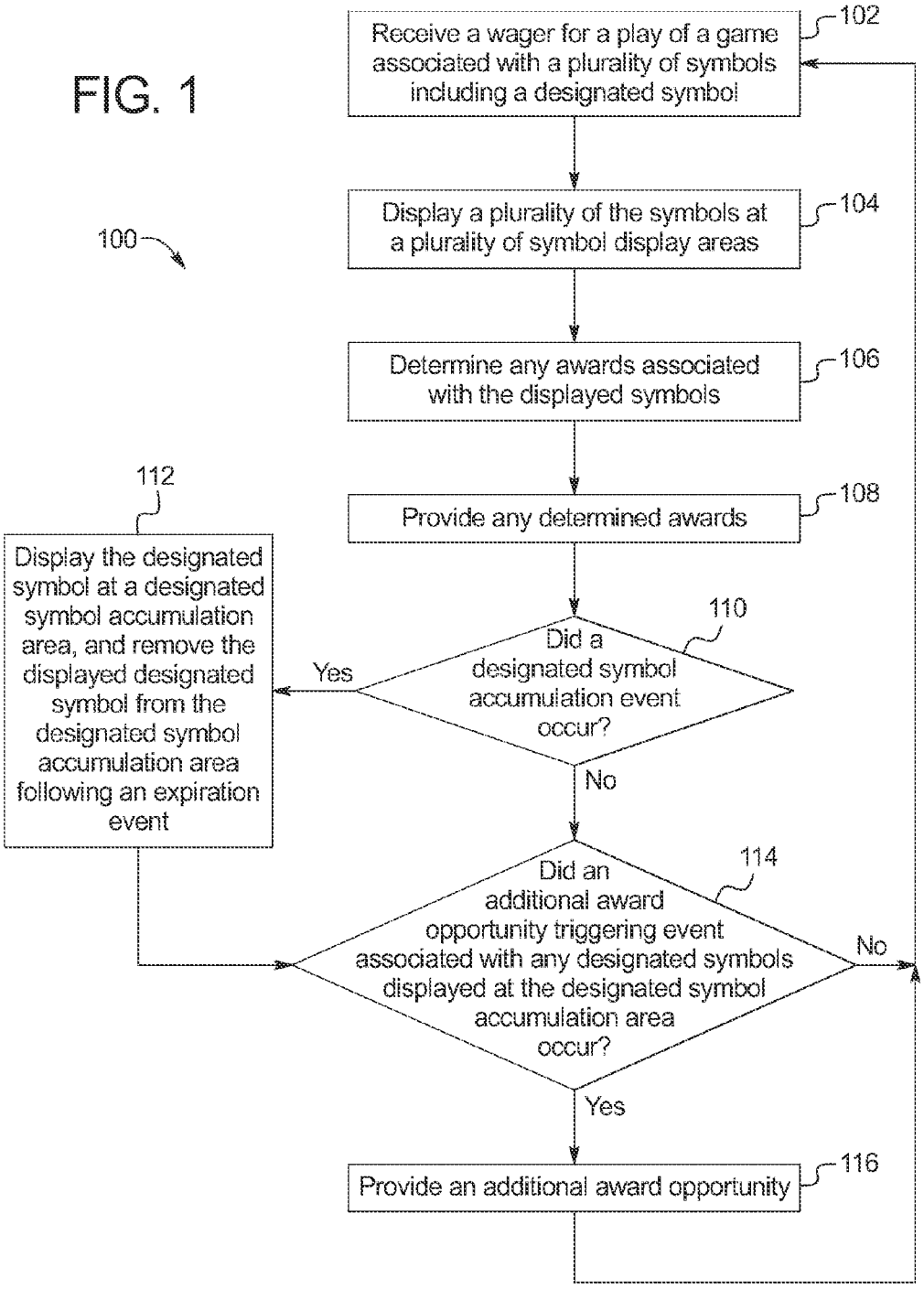
FIG. 1 is a flowchart illustrating an example method of operating an embodiment of the gaming system of the present disclosure.

FIG. 1 illustrates a flowchart of a process or method 100 for operating an example embodiment of the gaming system of the present disclosure. In various embodiments, process 100 is represented by a set of instructions stored in one or more memories and executed by one or more processors. Although process 100 is described with reference to the flowchart shown in FIG. 1, it should be appreciated that many other processes of performing the acts associated with this illustrated process may be employed. For example, the order of certain of the illustrated blocks and/or diamonds may be changed, certain of the illustrated blocks and/or diamonds may be optional, and/or certain of the illustrated blocks and/or diamonds may not be employed.

In operation of this example, the gaming system receives a wager for a play of a game, as indicated by block 102. The game is associated with a plurality of symbols including a designated symbol. The gaming system displays a plurality of the symbols at a plurality of symbol display areas, as indicated by block 104. The gaming system determines any awards associated with the displayed symbols, as indicated by block 106, and provides any determined awards, as indicated by block 108. The gaining system determines whether a designated symbol accumulation event occurred, as indicated by diamond 110. If the gaming system determines that the designated symbol accumulation event did not occur, process 100 proceeds to diamond 114, described below.

If the gaming system determines that the designated symbol accumulation event occurred, the gaming system displays the designated symbol at a designated symbol accumulation area (i.e., accumulates the designated symbol), as indicated by block 112. The gaming system removes the accumulated designated symbol from the designated symbol accumulation area following an expiration event, such as following an expiration of a designated period associated with that accumulated designated symbol. The gaming system determines whether an additional award opportunity triggering event occurred, as indicated by diamond 114. In this example, the additional award opportunity triggering event is associated with any accumulated designated symbols displayed at the designated symbol accumulation area. If the gaming system determines that the additional award opportunity triggering event did not occur, process 100 returns to block 102. If the gaming system determines that the additional award opportunity triggering event occurred, the gaming system provides an additional award opportunity, as indicated by block 116, and process 100 returns to block 102.

FIGS. 2A, 2B, 2C, 2D, 2E, 2F, 2G, 2H, 2I, and 2J illustrate screen shots of an example embodiment of the gaming system of the present disclosure. In this example, the gaming system is configured to operate a primary wagering game associated with a plurality of symbols including a BONUS symbol. The BONUS symbol is the designated symbol in this example, though it should be appreciated that any suitable symbol or symbols may be designated symbols. In this example, the gaming system displays (such as on a display device 1116 or 1118, described below) a plurality of symbol display areas 220*a*, 220*b*, 220*c*, 220*d*, 220*e*, 220*f*, 220*g*, 220*h*, 220*i*, 220*j*, 220*k*, 220*l*, 220*m*, 220*n*, and 220*o* arranged in a 3×5 matrix. Each of the symbol display areas is configured to display one of the symbols. The gaming system also displays a plurality of paylines for the primary wagering game. Each of the paylines is associated with a different plurality of the symbol display areas. Specifically, in this example, payline A 215*a* is associated with symbol display areas 220*a*, 220*b*, 220*c*, 220*d*, and 220*e*; payline B 215*b* is associated with symbol display areas 220*a*, 220*b*, 220*h*, 220*n*, and 220*o*; payline C 215*c* is associated with symbol display areas 220*f*, 220*g*, 220*h*, 220*i*, and 220*j*; payline D 215*d* is associated with symbol display areas 220*k*, 220*l*, 220*h*, 220*d*, and 220*e*; and payline E 215*e* is associated with symbol display areas 220*k*, 220*l*, 220*m*, 220*n*, and 220*o*. Payline A 215*a*, payline B 215*b*, payline C 215*c*, payline D 215*d*, and payline E 215*e* are sometimes referred to herein as paylines A, B C, D, and E.

Additionally, in this example the gaming system displays a designated symbol accumulation area 230. Designated symbol accumulation area 230 includes a plurality of designated symbol display areas 230*a*, 230*b*, 230*c*, 230*d*, and 230*e* arranged in a row. Each designated symbol display area is configured to display the designated symbol (as further described below).

The gaming system displays and employs a paytable 212 for the primary wagering game. Paytable 212 includes a plurality of winning symbol combinations and the credit payout associated with each respective winning symbol combination. Specifically, in this example, paytable 212 includes the credit payout associated with each respective winning symbol combination when the maximum wager, which is 50 credits in this example (but could be any suitable amount), is placed for a play of the primary wagering game. Specifically, winning symbol combination:

(a) SEVEN-SEVEN-SEVEN-SEVEN-SEVEN is associated with an award of 10,000 credits;
(b) DIAMOND-DIAMOND-DIAMOND-DIAMOND is associated with an award of 7,500 credits;
(c) DOLLAR SIGN-DOLLAR SIGN-DOLLAR SIGN-DOLLAR SIGN-DOLLAR SIGN is associated with an award of 5,000 credits;
(d) TRIPLE BAR-TRIPLE BAR-TRIPLE BAR-TRIPLE BAR is associated with an award of 2,000 credits;
(e) ORANGE-ORANGE-ORANGE-ORANGE is associated with an award of 500 credits; DOUBLE BAR-DOUBLE BAR-DOUBLE BAR is associated with an award of 375 credits;
(g) TRIPLE CHERRY-TRIPLE CHERRY-TRIPLE CHERRY is associated with an award of 250 credits;
(h) BAR-BAR-BAR is associated with an award of 100 credits; and
(i) CHERRY-CHERRY-CHERRY is associated with an award of 50 credits.

Additionally, in this example; the gaming system displays: a message display area 211, which displays information, notifications, and/or messages before, during, or after play of the primary wagering game; a credit meter 214, which displays a player's credit balance in the form of an amount of credits in this example; a wager indicator 216, which displays the player's wager for a play of the primary wagering game in the form of an amount of credits in this example; and an award meter 218, which displays any awards provided to the player in the form of an amount of credits in this example. While in this illustrated example the gaming system indicates the player's credit balance, the player's wager, and any awards provided to the player in the form of amounts of credits, it should be appreciated that such indications may alternatively or additionally be made in the form of amounts of currency.

In this example, the designated symbol accumulation event occurs when the BONUS symbol (i.e., the designated symbol in this example) is generated and displayed at one of the symbol display areas for a play of the primary wagering game. Thus, in this example, when the BONUS symbol is generated and displayed at one of the symbol display areas for a play of the primary wagering game, the gaming system displays the BONUS symbol at the designated symbol accumulation area (i.e., accumulates the BONUS symbol).

Additionally, in this example, the expiration event is an expiration of a designated period associated with each accumulated BONUS symbol. In this example, the designated period is a designated quantity of four plays of the primary wagering game. Thus, in this example, when a BONUS symbol is generated and displayed at one of the symbol display areas for a play of the primary wagering game, the gaming system displays the BONUS symbol at the designated symbol accumulation area for each of four consecutive plays of the primary wagering game following the play of the primary wagering game that caused that BONUS symbol to be displayed at the designated symbol accumulation area. For instance, if the BONUS symbol is generated and displayed at a symbol display area for a first play of the primary wagering game, the gaming system displays the BONUS symbol at the designated symbol accumulation area, and continues displaying the bonus symbol at the designated symbol accumulation area for each of a second subsequent, a third subsequent, a fourth subsequent, and a fifth subsequent play of the primary wagering game. It should be appreciated that each accumulated BONUS symbol displayed at the designated symbol accumulation area is associated with a distinct expiration event that governs or determines when the gaming system will remove that accumulated BONUS symbol from the designated symbol accumulation area. That is, each individual accumulated BONUS symbol displayed at the designated symbol accumulation area is removed from the designated symbol accumulation area independently of each of any other accumulated BONUS symbols following four consecutive plays of the primary wagering game.

In this example, the gaming system employs the designated symbol accumulation area and, more specifically, the designated symbol display areas of the designated symbol accumulation area, to indicate the remaining quantity of plays of the primary wagering game for which each accumulated BONUS symbol will be displayed at the designated symbol accumulation area. Specifically, when a BONUS symbol is generated and displayed for a play of the primary wagering game, the gaming system initially displays the BONUS symbol at the leftmost designated symbol display area 230*a* (i.e., accumulates the BONUS symbol). Upon the initiation of each subsequent play of the primary wagering game, the gaming system moves that accumulated BONUS symbol to the designated symbol display area immediately to the right of the designated symbol display area at which that accumulated BONUS symbol is displayed until there are no designated symbol display areas remaining. When there is no designated symbol display area immediately to the right of the designated symbol display area at which the accumulated BONUS symbol is displayed (i.e., when an accumulated BONUS symbol is displayed at designated symbol display area 230*e* in this example), upon initiation of a play of the primary wagering game, the gaming system removes that accumulated BONUS symbol from the designated symbol accumulation area.

For instance, if a BONUS symbol is generated and displayed at a symbol display area for a first play of the primary wagering game, the gaming system displays the BONUS symbol at designated symbol display area 230*a* (i.e., the leftmost designated symbol display area). Upon the initiation of a second subsequent play of the primary wagering game, the gaming system moves that accumulated BONUS symbol from designated symbol display area 230*a* to at designated symbol display area 230*b* (i.e., the designated symbol display area to the immediate right of designated symbol display area 230*a*). Upon the initiation of a third subsequent play of the primary wagering game, the gaming system moves that accumulated BONUS symbol from designated symbol display area 230*b* to designated symbol display area 230*c* (i.e., the designated symbol display area to the immediate right of designated symbol display area 230*b*). Upon the initiation of a fourth subsequent play of the primary wagering game, the gaming system moves that accumulated BONUS symbol from designated symbol display area 230*c* to designated symbol display area 230*d* (i.e., the designated symbol display area to the immediate right of designated symbol display area 230*c*). Upon the initiation of a fifth subsequent play of the primary wagering game, the gaming system moves that accumulated BONUS symbol from designated symbol display area 230*d* to designated symbol display area 230*e* (i.e., the designated symbol display area to the immediate right of designated symbol display area 230*d*). Upon the initiation of a sixth subsequent play of the primary wagering game, the gaming system removes that accumulated BONUS symbol from designated symbol display area 230*e*. It should thus be appreciated that, in this example, the BONUS symbol was displayed at the designated symbol accumulation area (and, specifically, at designated symbol display areas 230*b* to 230*e*) for the designated quantity of four plays of the primary wagering game following the play of the primary wagering game that caused that BONUS symbol to be accumulated and displayed at the designated symbol accumulation area. It should be appreciated that, in other embodiments, the gaming system displays the accumulated designated symbols moving from right to left, top to bottom, bottom to top, or in any other suitable manner and/or direction depending upon the configuration of the designated symbol display areas of the designated symbol accumulation area.

Further, in this example, the additional award opportunity triggering event occurs when the designated symbol accumulation area simultaneously displays at least a designated quantity of three accumulated BONUS symbols for a play of the primary wagering game. In this example, the gaming system provides an additional award opportunity in the form of a play of a bonus game when the additional award opportunity triggering event occurs. It should be appreciated that the designated quantity may be any suitable quantity.

Figure 2A:
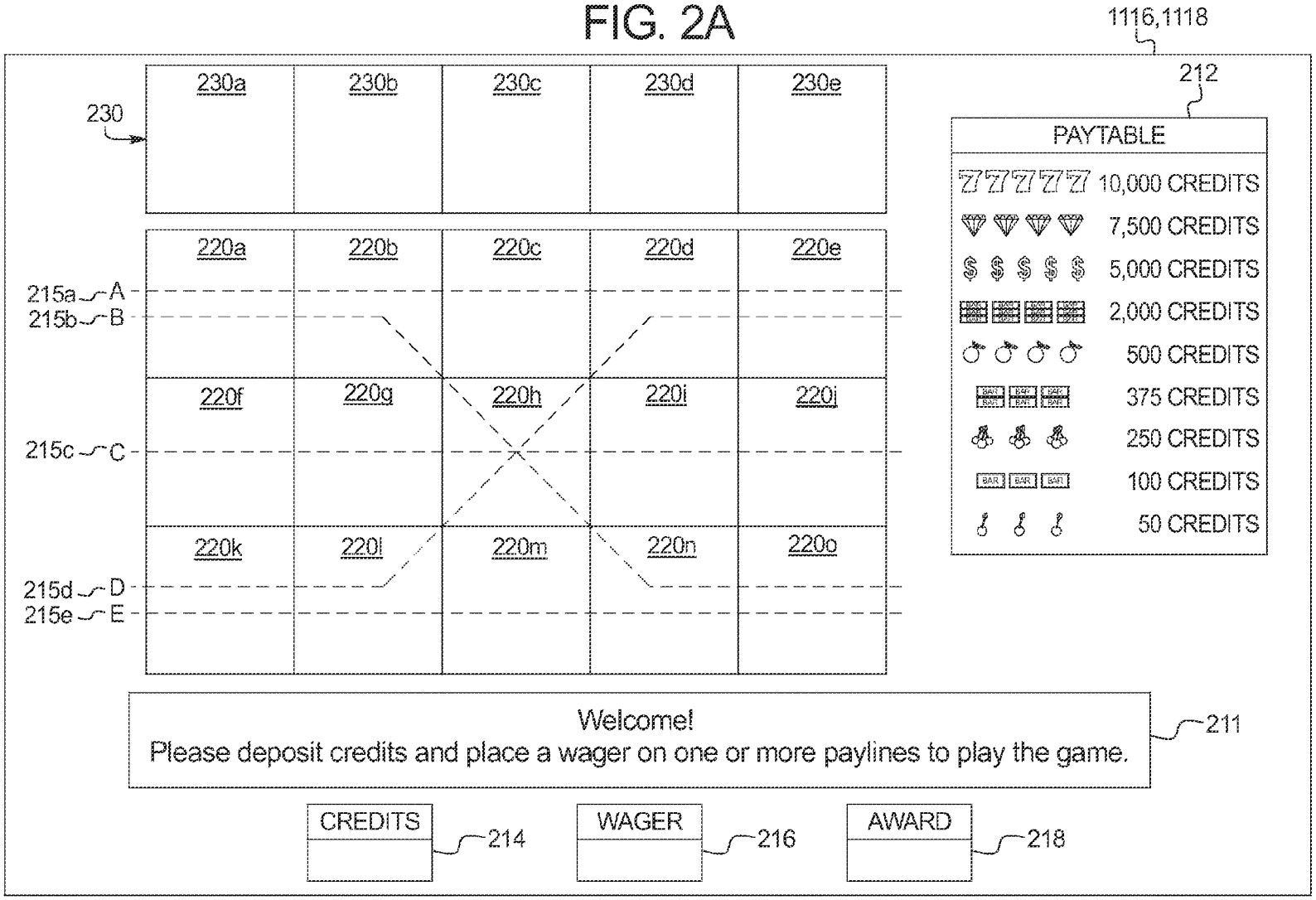
FIGS. 2A, 2B, 2C, 2D, 2E, 2F, 2G, 2H, 2I, and 2J illustrate screen shots of an example of an embodiment of the gaming system of the present disclosure configured to provide an additional award opportunity when at least a designated quantity of accumulated BONUS symbols are displayed at the designated symbol accumulation area.

Turning to FIG. 2A, in this example, when the gaming system is not being played, message display area 211 displays a message that invites a player to deposit value (e.g., insert currency or a redeemable ticket having a cash value into a payment acceptor of the gaming system, as further described below) to fund the gaming system and to place a wager on one or more of the paylines to play the primary wagering game. Specifically, in this example, message display area 211 displays the following message: "Welcome! Please deposit credits and place a wager on one or more paylines to play the game."

Figure 2B:
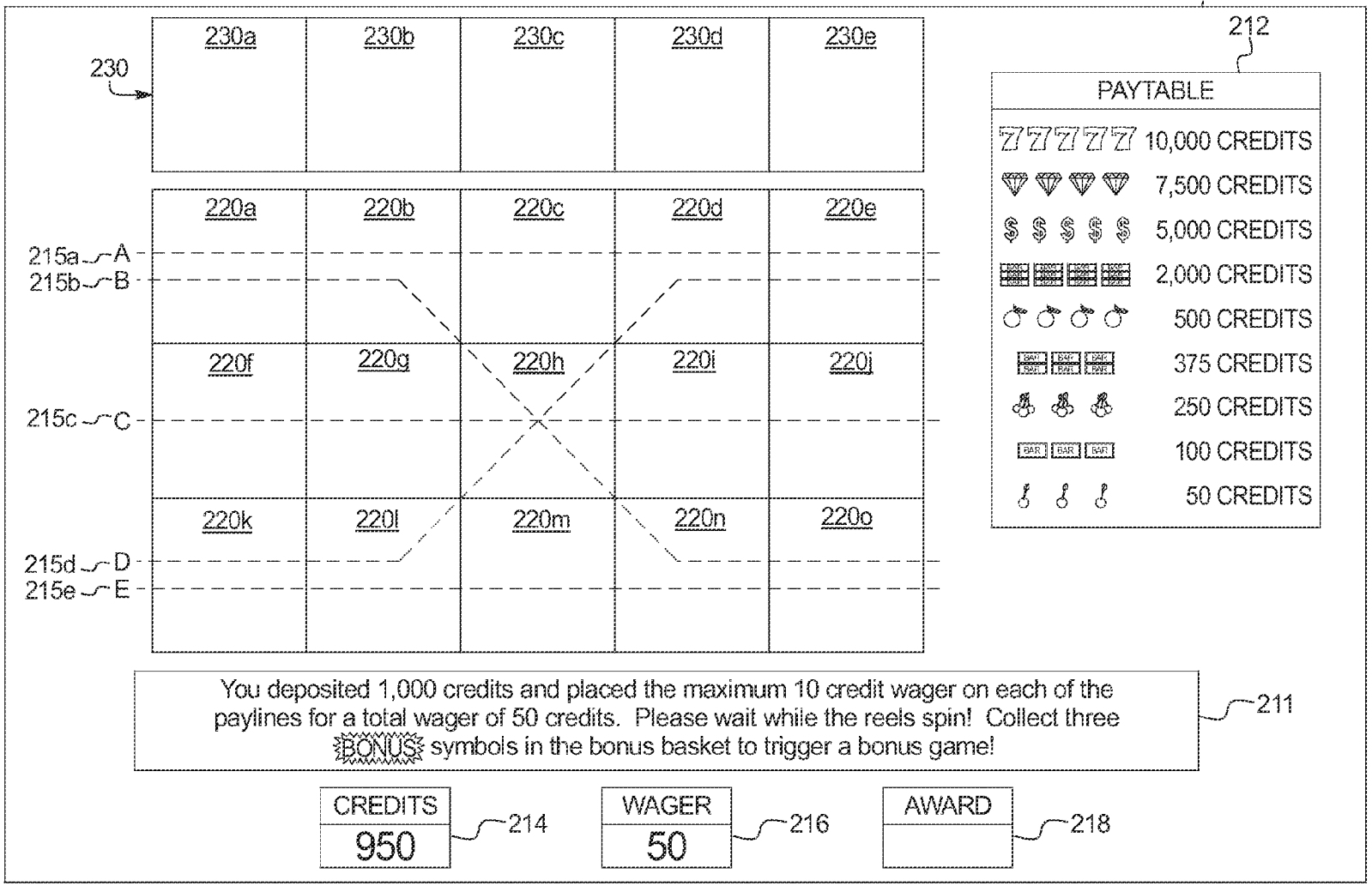

As illustrated in FIG. 2B, a player funded the gaming system by depositing value. The gaming system provided the player with 1,000 credits, which represented the deposited value in this example. The player subsequently placed the maximum wager of 50 credits by placing a 10 credit wager on each of paylines A, B, C, D, E to activate each of the paylines for a play of the primary wagering game. Wager indicator 216 displayed the player's wager of 50 credits. Credit meter 214 displayed the player's total remaining credit balance of 950 credits (i.e., the player's initial credit balance of 1,000 credits minus the player's wager of 50 credits). Message display area 211 displayed a message notifying the player that if three accumulated BONUS symbols are simultaneously displayed in the designated symbol accumulation area, the gaming system will initiate a bonus game. Specifically, message display area 211 displayed the following message: "You deposited 1,000 credits and placed the maximum 10 credit wager on each of the paylines for a total wager of 50 credits. Please wait while the reels spin! Collect three BONUS symbols in the bonus basket to trigger a bonus game!"

In this example, upon initiation of a play of the primary wagering game, the gaming system: (a) removes any accumulated BONUS symbol displayed at the rightmost designated symbol display area (i.e., designated symbol display area 230*e*); (b) for each of any accumulated BONUS symbols displayed at any of the other designated symbol display areas (i.e., designated symbol display areas 230*a*, 230*b*, 230*c*, and 230*d*), moves that accumulated BONUS symbol to the designated symbol display area to the immediate right of the designated symbol display area at which that accumulated BONUS symbol is displayed; and (c) determines and displays an outcome for the play of the primary wagering game by generating and displaying a plurality of the symbols at the symbol display areas.

Figure 2C:
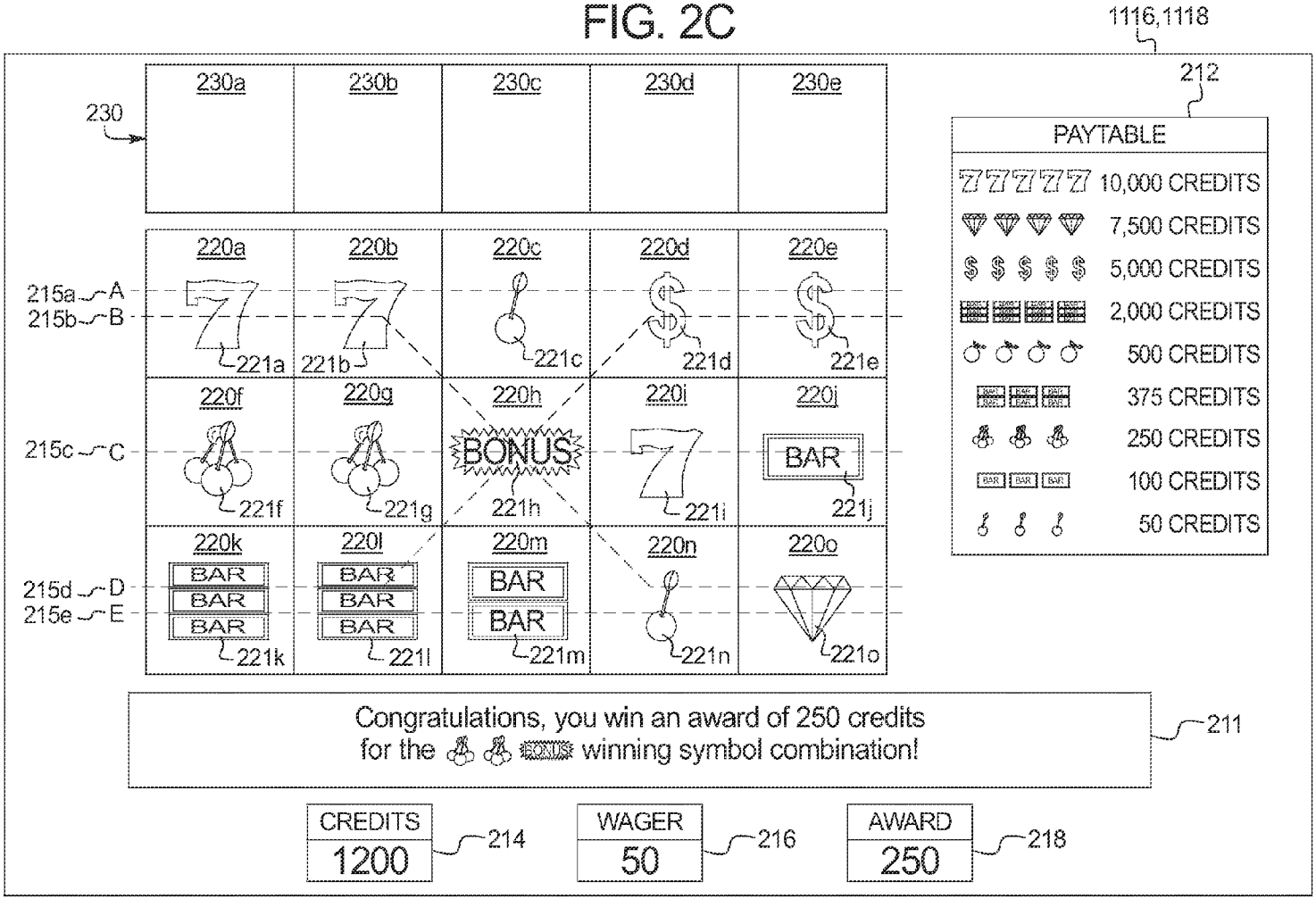

As illustrated in FIG. 2C, upon initiation of a play of the primary wagering game, the gaming system determined and displayed an outcome for the play of the primary wagering game. Specifically, the gaming system generated and displayed: SEVEN symbol 221*a* at symbol display area 220*a*, SEVEN symbol 221*b* at symbol display area 220*b*, CHERRY symbol 221*c* at symbol display area 220*c*, DOLLAR SIGN symbol 221*d* at symbol display area 220*d*, DOLLAR SIGN symbol 221*e* at symbol display area 220*e*, TRIPLE CHERRY symbol 221*f* at symbol display area 220*f*, TRIPLE CHERRY symbol 221*g* at symbol display area 220*g*, BONUS symbol 221*h* at symbol display area 220*h*, SEVEN symbol 221*i* at symbol display area 220*i*, BAR symbol 221*j* at symbol display area 220*j*, TRIPLE BAR symbol 221*k* at symbol display area 220*k*, TRIPLE BAR symbol 221*l* at symbol display area 220*l*, DOUBLE BAR symbol 221*m* at symbol display area 220*m*, CHERRY symbol 221*n* at symbol display area 220*n*, and DIAMOND symbol 221*o* at symbol display area 220*o*.

The gaming system made an award determination based on the displayed symbols. That is, the gaming system determined whether the displayed symbols formed any of the winning symbol combinations included in paytable 212 along wagered-on paylines A, B, C, D, and/or E. In this example, the BONUS symbol acts as a wild symbol. Specifically, for this play of the primary wagering game, the gaming system determined an award of 250 credits for the TRIPLE CHERRY-TRIPLE CHERRY-BONUS winning symbol combination formed by TRIPLE CHERRY symbol 221*f*, TRIPLE CHERRY symbol 221*g*, and BONUS symbol 221*h* displayed from left to right along payline C (which acts as a TRIPLE CHERRY-TRIPLE CHERRY-TRIPLE CHERRY winning symbol combination by virtue of BONUS symbol 221*h* acting as a wild symbol). Accordingly, the gaming system displayed the 250 credit award in award indicator 218 and updated the player's credit balance indicated by credit meter 214 to 1200 credits to reflect the 250 credit award. Message display area 211 displayed the following message: "Congratulations, you win an award of 250 credits for the TRIPLE CHERRY-TRIPLE CHERRY-BONUS winning symbol combination!"

Figure 2D:
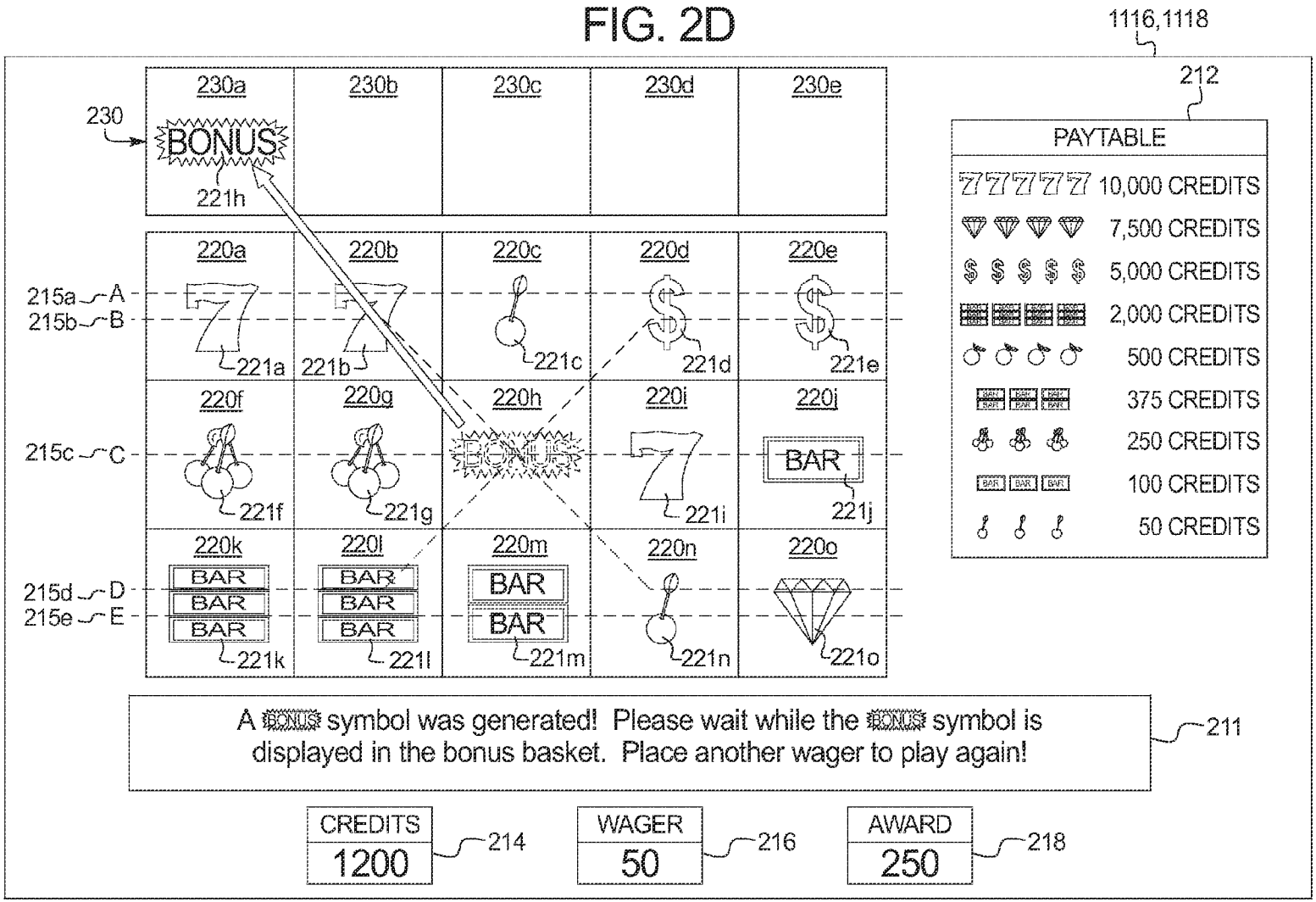

The gaming system determined whether a BONUS symbol was generated and displayed at one of the symbol display areas (i.e., determined whether the designated symbol accumulation event occurred in this example). For this play of the primary wagering game, BONUS symbol 221*h* was generated and displayed at symbol display area 220*h*. Accordingly, as illustrated in FIG. 2D, the gaming system displayed BONUS symbol 221*h* at designated symbol display area 230*a* (i.e., accumulated BONUS symbol 221*h*). The gaming system determined whether designated symbol accumulation area 230 displayed at least three accumulated BONUS symbols (i.e., determined whether the additional award opportunity triggering event occurred in this example). For this play of the primary wagering game, designated symbol accumulation area 230 displayed only one accumulated BONUS symbol (i.e., accumulated BONUS symbol 221*h*). Thus, the gaming system determined that the additional award opportunity triggering event did not occur for this play of the primary wagering game. Message display area 211 displayed the following message: "A BONUS symbol was generated! Please wait while the BONUS symbol is displayed in the bonus basket. Place another wager to play again!"

Figure 2E:
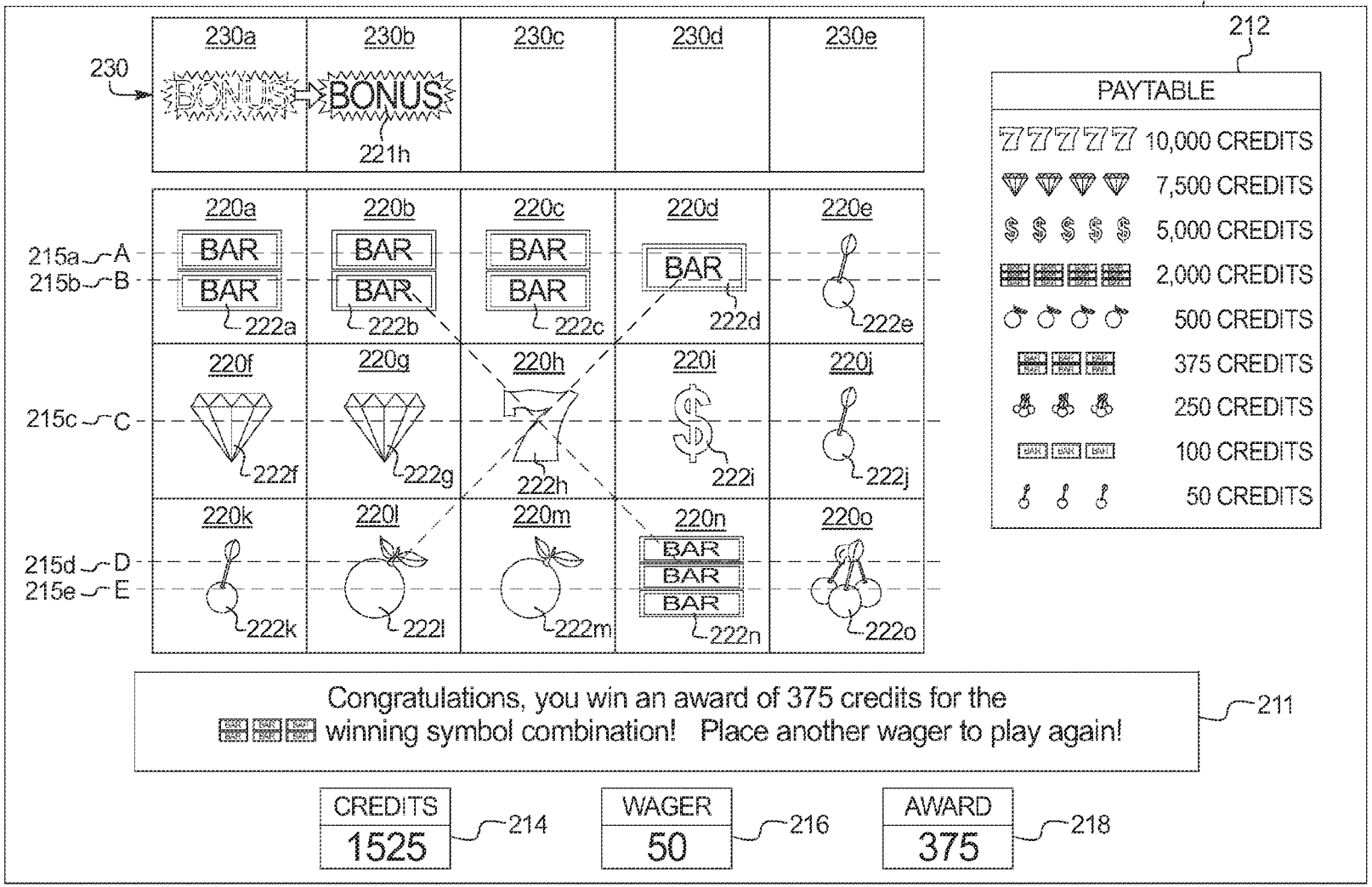

As illustrated in FIG. 2E, upon initiation of a subsequent play of the primary wagering game, the gaming system moved accumulated BONUS symbol 221*h* from designated symbol display area 230*a* to designated symbol display area 230*b*, which is the designated symbol display area to the immediate right of designated symbol display area 230*a*. Additionally, upon initiation of this play of the primary wagering game, the gaming system determined and displayed an outcome for the play of the primary wagering game. Specifically, the gaming system generated and displayed: DOUBLE BAR symbol 222*a* at symbol display area 220*a*, DOUBLE BAR symbol 222*b* at symbol display area 220*b*, DOUBLE BAR symbol 222*c* at symbol display area 220*c*, BAR symbol 222*d* at symbol display area 220*d*, CHERRY symbol 222*e* at symbol display area 220*e*, DIAMOND symbol 222*f* at symbol display area 220*f*, DIAMOND symbol 222*g* at symbol display area 220*g*, SEVEN symbol 222*h* at symbol display area 220*h*, DOLLAR SIGN symbol 222*i* at symbol display area 220*i*, CHERRY symbol 222*j* at symbol display area 220*j*, CHERRY symbol 222*k* at symbol display area 220*k*, ORANGE symbol 222*l* at symbol display area 220*l*, ORANGE symbol 222*m* at symbol display area 220*m*, TRIPLE BAR symbol 222*n* at symbol display area 220*n*, and TRIPLE CHERRY symbol 222*o* at symbol display area 220*o*.

The gaming system made an award determination based on the displayed symbols. Specifically, for this play of the primary wagering game, the gaming system determined an award of 375 credits for the DOUBLE BAR-DOUBLE BAR-DOUBLE BAR winning symbol combination formed by DOUBLE BAR symbol 222*a*, DOUBLE BAR symbol 222*b*, and DOUBLE BAR symbol 222*c* displayed from left to right along payline A. Accordingly, the gaming system displayed the 375 credit award in award indicator 218 and updated the player's credit balance indicated by credit meter 214 to 1525 credits to reflect the 375 credit award. Message display area 211 displayed the following message: "Congratulations, you win an award of 375 credits for the DOUBLE BAR-DOUBLE BAR-DOUBLE BAR winning symbol combination!"

The gaming system determined whether a BONUS symbol was generated and displayed at one of the symbol display areas (i.e., determined whether the designated symbol accumulation event occurred in this example). For this play of the primary wagering game, a BONUS symbol was not generated and displayed at any symbol display areas. Thus, the gaming system determined that the designated symbol accumulation event did not occur and, accordingly, did not accumulate any BONUS symbol. The gaming system determined whether designated symbol accumulation area 230 displayed at least three accumulated BONUS symbols (i.e., determined whether the additional award opportunity triggering event occurred in this example). For this play of the primary wagering game, designated symbol accumulation area 230 displayed only one accumulated BONUS symbol (i.e., accumulated BONUS symbol 221*h*). Thus, the gaming system determined that the additional award opportunity triggering event did not occur for this play of the primary wagering game.

Figure 2F:
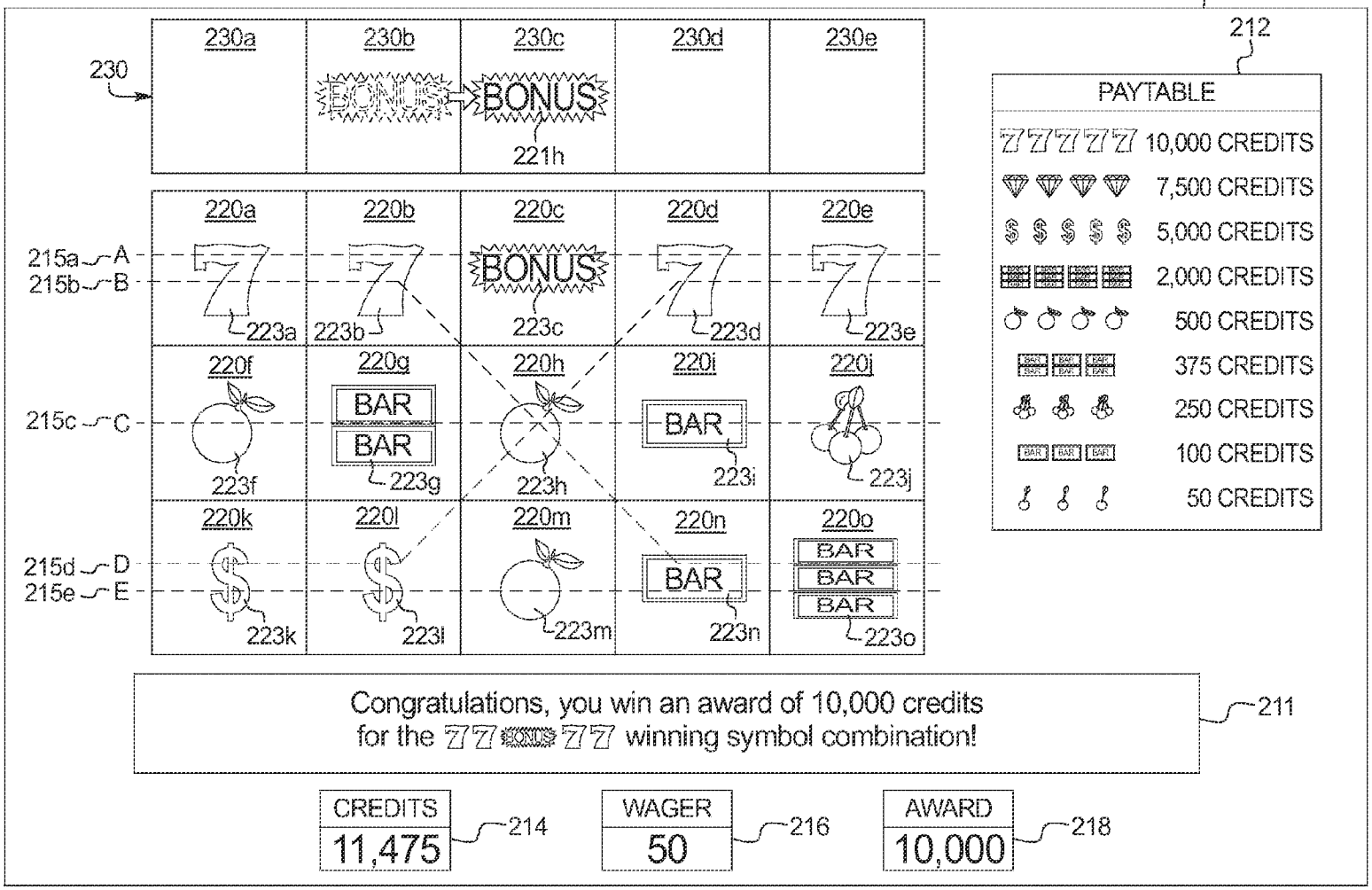

As illustrated in FIG. 2F, upon initiation of a subsequent play of the primary wagering game, the gaming system moved accumulated BONUS symbol 221*h* from designated symbol display area 230*b* to designated symbol display area 230*c*, which is the designated symbol display area to the immediate right of designated symbol display area 230*b*. Additionally, upon initiation of this play of the primary wagering game, the gaming system determined and displayed an outcome for the play of the primary wagering game. Specifically, the gaming system generated and displayed: SEVEN symbol 223*a* at symbol display area 220*a*, SEVEN symbol 223*b* at symbol display area 220*b*, BONUS symbol 223*c* at symbol display area 220*c*, SEVEN symbol 223*d* at symbol display area 220*d*, SEVEN symbol 223*e* at symbol display area 220*e*, ORANGE symbol 223*f* at symbol display area 220*f*, DOUBLE BAR symbol 223*g* at symbol display area 220*g*, ORANGE symbol 223*h* at symbol display area 220*h*, BAR symbol 223*l* at symbol display area 220*l*, TRIPLE CHERRY symbol 223*l* at symbol display area 220*j*, DOLLAR SIGN symbol 223*k* at symbol display area 220*k*, DOLLAR SIGN symbol 223*l* at symbol display area 220*l*, ORANGE symbol 223*m* at symbol display area 220*m*, BAR symbol 223*n* at symbol display area 220*n*, and TRIPLE BAR symbol 223*o* at symbol display area 220*o*.

The gaming system made an award determination based on the displayed symbols. Specifically, for this play of the primary wagering game, the gaming system determined an award of 10,000 credits for the SEVEN-SEVEN-BONUS-SEVEN-SEVEN winning symbol combination formed by SEVEN symbol 223*a*, SEVEN symbol 223*b*, BONUS symbol 223*c*, SEVEN symbol 223*d*, and SEVEN symbol 223*e* displayed from left to right along payline A (which acts as a SEVEN-SEVEN-SEVEN-SEVEN-SEVEN winning symbol combination by virtue of BONUS symbol 223*c* acting as a wild symbol). Accordingly, the gaming system displayed the 10,000 credit award in award indicator 218 and updated the player's credit balance indicated by credit meter 214 to 11,475 credits to reflect the 10,000 credit award. Message display area 211 displayed the following message: "Congratulations, you win an award of 10,000 credits for the SEVEN-SEVEN-BONUS-SEVEN-SEVEN winning symbol combination!"

Figure 2G:
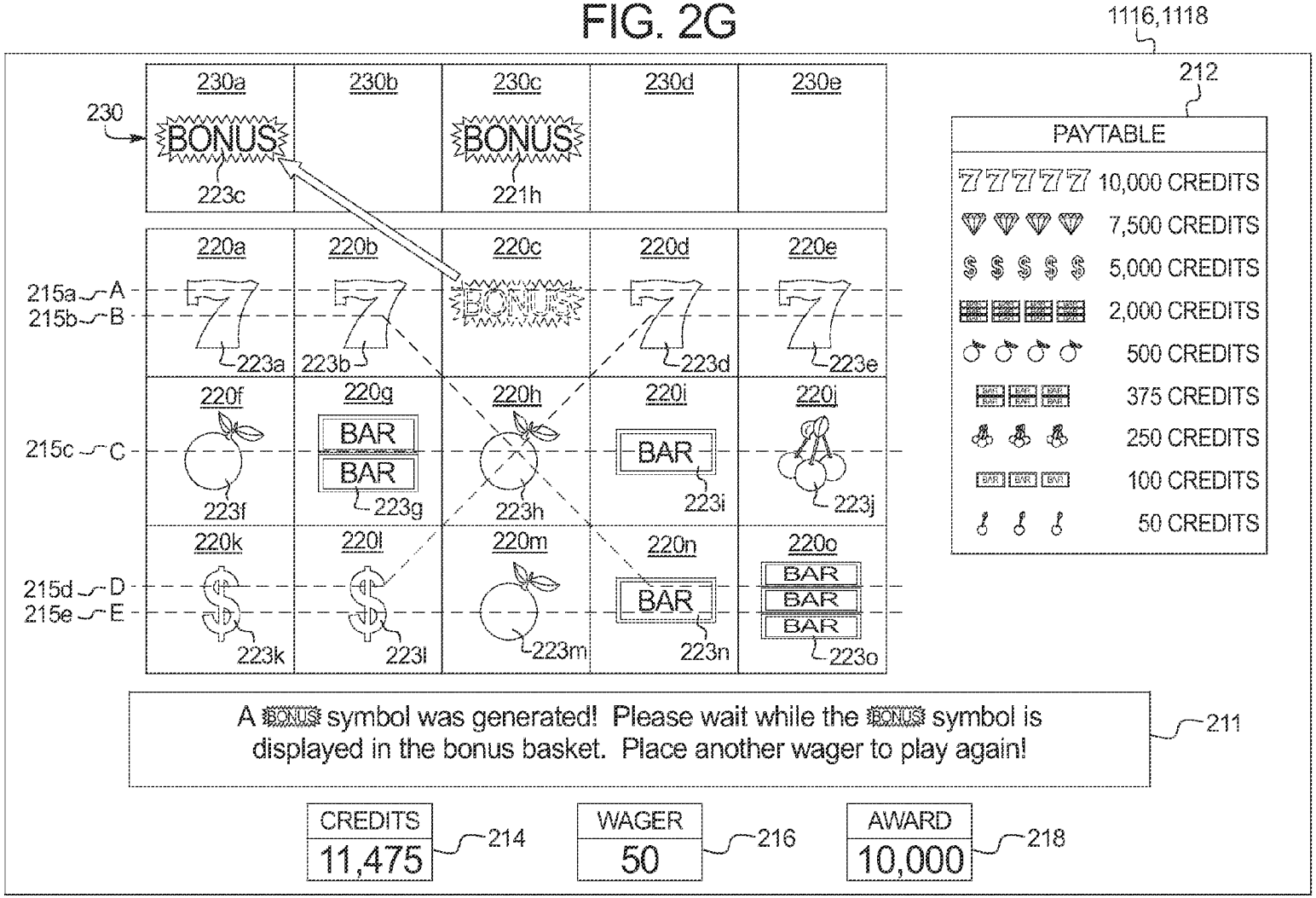

The gaming system determined whether a BONUS symbol was generated and displayed at one of the symbol display areas (i.e., determined whether the designated symbol accumulation event occurred in this example). For this play of the primary wagering game, BONUS symbol 223*c* was generated and displayed at symbol display area 220*c*. Accordingly, as illustrated in FIG. 2G, the gaming system displayed BONUS symbol 223*c* at designated symbol display area 230*a* (i.e., accumulated BONUS symbol 223*c*). The gaming system determined whether designated symbol accumulation area 230 displayed at least three accumulated BONUS symbols determined whether the additional award opportunity triggering event occurred in this example). For this play of the primary wagering game, designated symbol accumulation area 230 displayed only two accumulated BONUS symbols (i.e., accumulated BONUS symbols 221*h* and 223*c*). Thus, the gaming system determined that the additional award opportunity triggering event did not occur for this play of the primary wagering game. Message display area 211 displayed the following message: "A BONUS symbol was generated! Please wait while the BONUS symbol is displayed in the bonus basket. Place another wager to play again!"

Figure 2H:
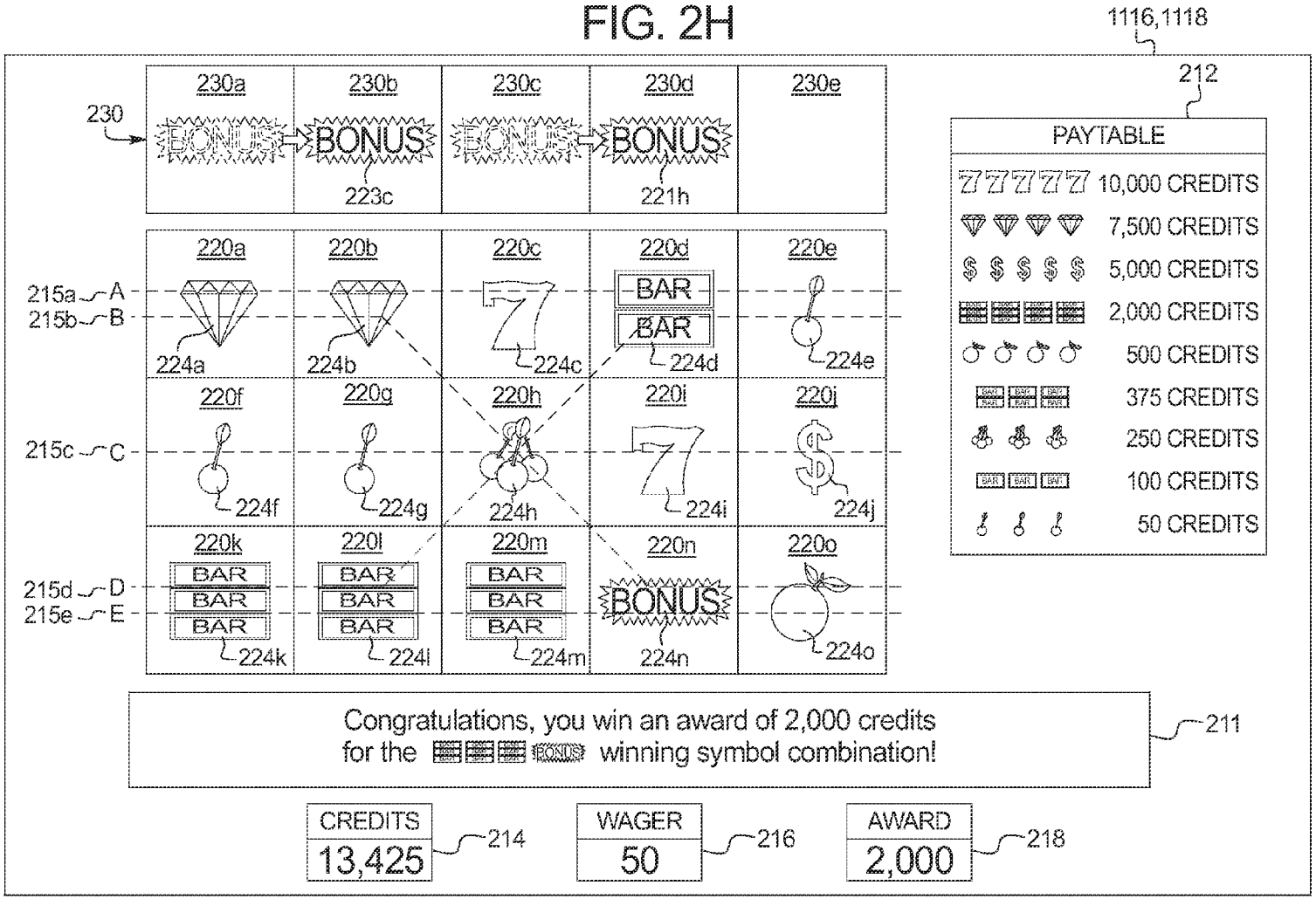

As illustrated in FIG. 2H, upon initiation of a subsequent play of the primary wagering game, the gaming system moved accumulated BONUS symbol 221*h* from designated symbol display area 230*c* to designated symbol display area 230*d*, which is the designated symbol display area to the immediate right of designated symbol display area 230*c*, and moved accumulated BONUS symbol 223*c* from designated symbol display area 230*a* to designated symbol display area 230*b*, which is the designated symbol display area to the immediate right of designated symbol display area 230*a*. Additionally, upon initiation of this play of the primary wagering game, the gaming system determined and displayed an outcome for the play of the primary wagering game. Specifically, the gaming system generated and displayed: DIAMOND symbol 224*a* at symbol display area 220*a*, DIAMOND symbol 224*b* at symbol display area 220*b*, SEVEN symbol 224*c* at symbol display area 220*c*, DOUBLE BAR symbol 224*d* at symbol display area 220*d*, CHERRY symbol 224*e* at symbol display area 220*e*, CHERRY symbol 224*f* at symbol display area 220*f*, CHERRY symbol 224*g* at symbol display area 220*g*, TRIPLE CHERRY symbol 224*h* at symbol display area 220*h*, SEVEN symbol 224*i* at symbol display area 220*i*, DOLLAR SIGN symbol 224*j* at symbol display area 220*j*, TRIPLE BAR symbol 224*k* at symbol display area 220*k*, TRIPLE BAR symbol 224*l* at symbol display area 220*l*, TRIPLE BAR symbol 224*m* at symbol display area 220*m*, BONUS symbol 224*n* at symbol display area 220*n*, and ORANGE symbol 224*o* at symbol display area 220*o*.

The gaming system made an award determination based on the displayed symbols. Specifically, the gaming system determined an award of 2,000 credits for the TRIPLE BAR-TRIPLE BAR-TRIPLE BAR-BONUS winning symbol combination formed by TRIPLE BAR symbol 224*k*, TRIPLE BAR symbol 224*l*, TRIPLE BAR symbol 224*m*, and BONUS symbol 224*n* displayed from left to right along payline E (which acts as a TRIPLE BAR-TRIPLE BAR-TRIPLE BAR-TRIPLE BAR winning symbol combination by virtue of BONUS symbol 224*n* acting as a wild symbol). Accordingly, the gaming system displayed the 2,000 credit award in award indicator 218 and updated the player's credit balance indicated by credit meter 214 to 13,425 credits to reflect the 2,000 credit award. Message display area 211 displayed the following message: "Congratulations, you win an award of 2,000 credits for the TRIPLE BAR-TRIPLE BAR-TRIPLE BAR-BONUS winning symbol combination!"

Figure 2I:
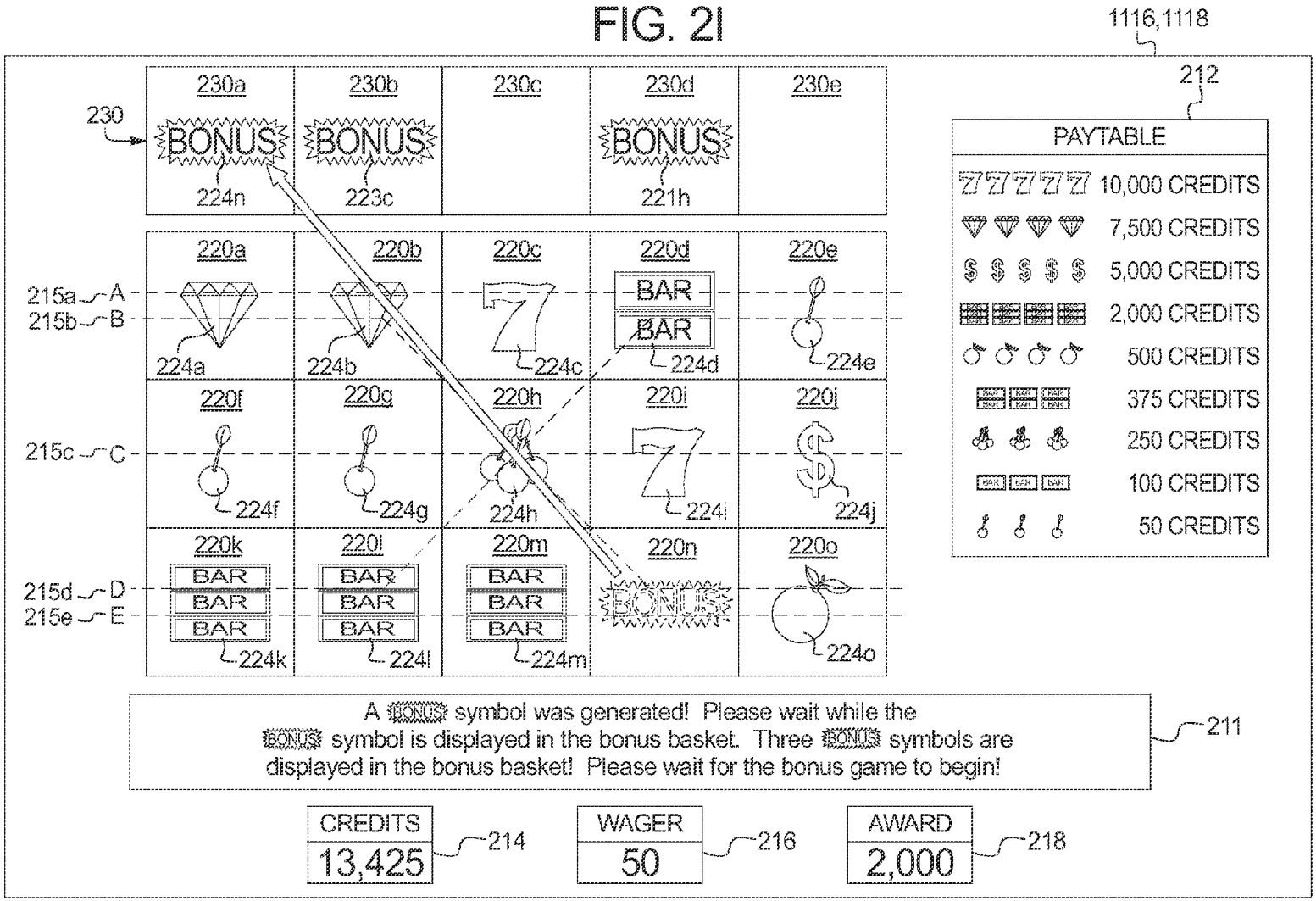

The gaming system determined whether a BONUS symbol was generated and displayed at one of the symbol display areas (i.e., determined whether the designated symbol accumulation event occurred in this example). For this play of the primary wagering game, BONUS symbol 224*n* was generated and displayed at symbol display area 220*n*. Accordingly, as illustrated in FIG. 2I, the gaming system displayed BONUS symbol 224*n* at designated symbol display area 230*a* (i.e., accumulated BONUS symbol 224*n*). The gaming system determined whether designated symbol accumulation area 230 displayed at least three accumulated BONUS symbols (i.e., determined whether the additional award opportunity triggering event occurred in this example). For this play of the primary wagering game, designated symbol accumulation area 230 displayed three accumulated BONUS symbols (i.e., accumulated BONUS symbols 221*h*, 223*c*, and 224*n*). Thus, the gaming system determined that the additional award opportunity triggering event occurred for this play of the primary wagering game. Message display area 211 displayed the following message: "A BONUS symbol was generated! Please wait while the BONUS symbol is displayed in the bonus basket. Place another wager to play again!"

Figure 2J:
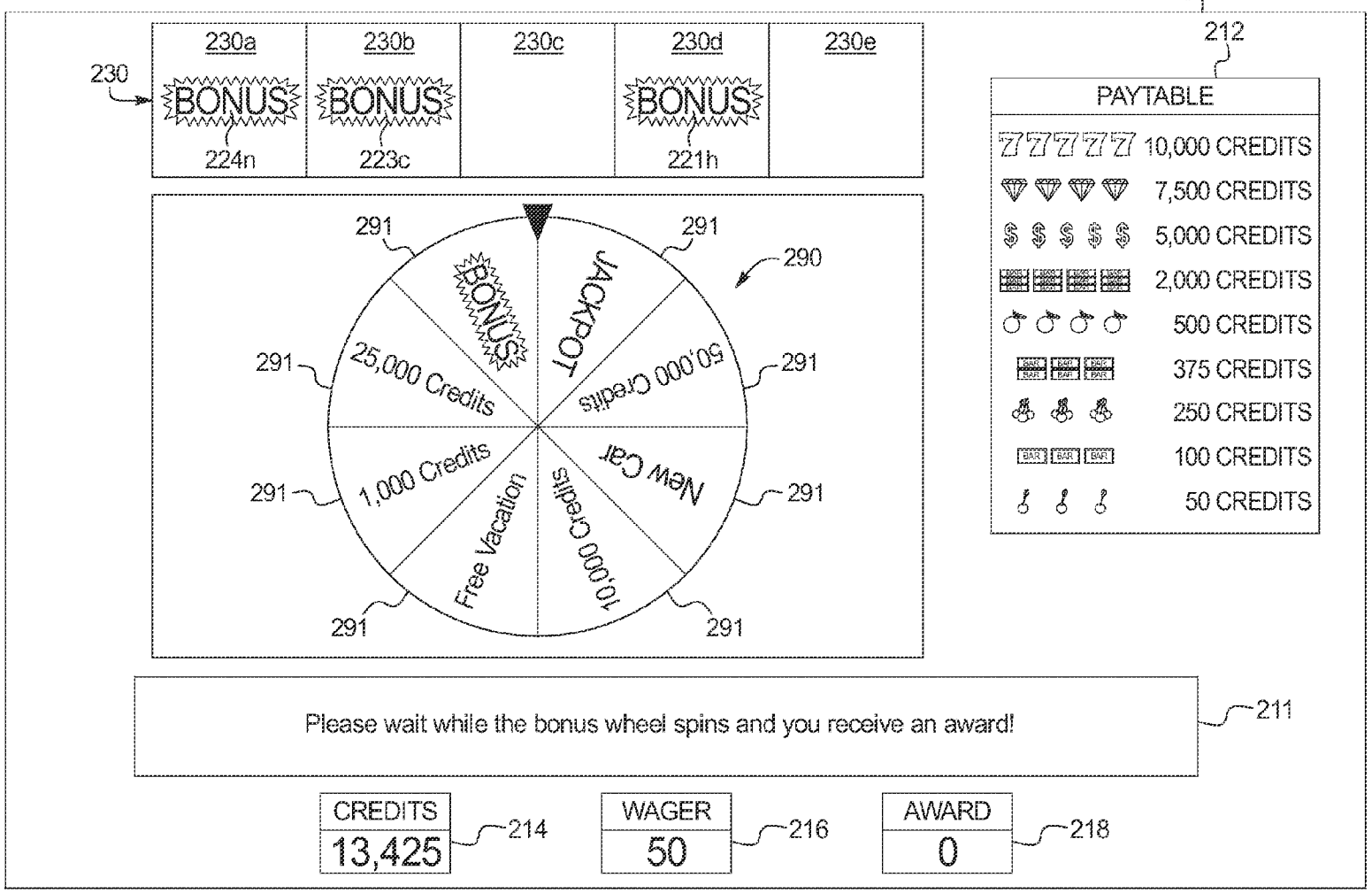

As shown in FIG. 2J, upon the occurrence of the additional award opportunity triggering event, the gaming system provided an additional award opportunity in the form of a play of a bonus game. Specifically, in this illustrated embodiment, the bonus game includes a bonus wheel 290 including a plurality of segments 291, each of which is associated with an award. The gaming system spins and stops bonus wheel 290 to indicate one of the segments 291, and provides the player the award associated with that indicated segment. It should be appreciated that one of the segments is associated with an award of a BONUS symbol. In this embodiment, if the segment associated with the BONUS symbol is indicated, the gaming system displays the BONUS symbol at the designated symbol accumulation area (i.e., accumulates the BONUS symbol) and spins the bonus wheel again. It should thus be appreciated that, in this embodiment, the player may accumulate BONUS symbols during play of the bonus game itself, rendering the bonus game a self-perpetuating bonus game.

In various embodiments in which the additional award opportunity triggering event occurs when the designated symbol accumulation area displays at least a first designated quantity of accumulated designated symbols for a play of the primary wagering game, the gaming system provides a modifier (such as a multiplier) in addition to the additional award opportunity if the designated symbol accumulation area displays at least a second greater designated quantity of accumulated designated symbols for the play of the primary wagering game. In one example, the first designated quantity is three and the second designated quantity is four. Thus, in this example, the gaming system provides the player with an additional award opportunity and a modifier when the designated symbol accumulation area displays four accumulated designated symbols for a play of the primary wagering game. In one embodiment, a value of the modifier increases as the quantity of accumulated designated symbols displayed at the designated symbol accumulation area in excess of the designated quantity of the accumulated designated symbols increases. In one example of this embodiment in which the designated quantity of the accumulated designated symbols is three, the gaming system provides the player with a modifier having a relatively higher value when the designated symbol accumulation area displays five accumulated designated symbols for a play of the primary wagering game than when the designated symbol accumulation area displays four accumulated designated symbols for a play of the primary wagering game.

In various embodiments in which the designated symbol is a BONUS symbol, the BONUS symbol does not act as a wild symbol. In one such embodiment, when the gaming system generates and displays a BONUS symbol at a symbol display area for a play of the primary wagering game, the gaming system displays the BONUS symbol at the designated symbol accumulation area (i.e., accumulates the BONUS symbol) and replaces the BONUS symbol displayed at the symbol display area with a randomly determined one of the symbols. In another such embodiment, when the gaming system generates and displays a BONUS symbol at a symbol display area for a play of the primary wagering game, the gaming system displays the BONUS symbol at the designated symbol accumulation area (i.e., accumulates the BONUS symbol), removes the BONUS symbol from the symbol display area, cascades any symbols displayed at symbol display areas located above that symbol display area downward to fill any empty symbol display areas, and displays a randomly determined one of the symbols in any empty symbol display areas.

It should be appreciated that the expiration event may be any suitable event. In various embodiments, the expiration event occurs: (a) upon an expiration of a designated period of time, (b) following a designated quantity of plays of a game, (c) randomly, (d) based on a player's player tracking level, (e) based on game play, (f) independently of game play, (g) based on coin-in, and/or (h) upon the occurrence of any suitable event(s) or based on any suitable factor(s).

In certain embodiments, the gaming system prolongs the stay of an accumulated designated symbol displayed at the designated symbol accumulation area. For example, in one such embodiment, the gaming system extends the designated period of time for which an accumulated designated symbol is displayed at the designated symbol accumulation area. In another such embodiment, the gaming system extends the designated quantity of plays of a game for which an accumulated designated symbol is displayed at the designated symbol accumulation area. In another such embodiment, the gaming system increases the quantity of designated symbol display areas included in the designated symbol accumulation area. Conversely, in other embodiments, the gaming system shortens the stay of a displayed designated symbol accumulation area. In one embodiment, the gaming system individually prolongs the stay of fewer than all of a plurality of accumulated designated symbols displayed at the designated symbol accumulation area. In another embodiment, the gaming system prolongs the stay of all accumulated designated symbols displayed at the designated symbol accumulation area.

In various embodiments, the gaming system generates and displays a plurality of designated symbols for a play of the primary wagering game in certain instances. In one such embodiment, if the gaming system generates and displays a plurality of designated symbols for a play of the primary wagering game, the gaming system displays a single designated symbol at the designated symbol accumulation area (i.e., accumulates a single designated symbol). In another such embodiment, if the gaming system generates and displays a plurality of designated symbols for a play of the primary wagering game, the gaming system displays each of the plurality of generated and displayed designated symbols at the designated symbol accumulation area (i.e., accumulates each of the designated symbols). In another such embodiment, if the gaming system generates and displays a plurality of designated symbols for a play of the primary wagering game, the gaming system displays a single designated symbol at the designated symbol accumulation area (i.e., accumulates a single designated symbol) and also determines and provides a modifier. In one example, the modifier increases for each additional generated and displayed designated symbol following the first generated and displayed designated symbol.

In one embodiment, the additional award opportunity triggering event occurs when at least a designated quantity of the designated symbol is generated and displayed within a designated period, such as a designated period of time or a designated quantity of plays of a game. In another embodiment, the additional award opportunity triggering event occurs when the designated symbol accumulation area simultaneously displays at least a designated quantity of accumulated designated symbols at a predetermined or randomly determined point in time.

In one embodiment, after the additional award opportunity triggering event occurs, the gaming system removes from the designated symbol accumulation area any accumulated designated symbols that at least in part caused the additional award opportunity triggering event to occur. In another embodiment, after the additional award opportunity triggering event occurs, the gaming system removes from the designated symbol accumulation area at least one, but fewer than all, of any accumulated designated symbols. It should be appreciated that the gaming system may determine which displayed designated symbol to remove in any suitable manner, such as by random selection. In other embodiments, the gaming system does not remove any accumulated designated symbols from the designated symbol accumulation area after the additional award opportunity triggering event occurs.

In certain embodiments, the symbols include a plurality of different designated symbols, each of which is associated with a different additional award opportunity. In one such embodiment, each of the designated symbols may be accumulated and displayed at the designated symbol accumulation area. In this embodiment, the additional award opportunity that the gaming system provides to the player depends upon which of the designated symbols are accumulated and displayed at the designated symbol accumulation area. In one example, the symbols include a first designated symbol associated with an additional award opportunity of five free spins and a second designated symbol associated with a free play of a wheel bonus game. In this example, the gaming system provides the player with five free spins when the designated symbol accumulation area displays at least the designated quantity of accumulated first designated symbols, and the gaming system provides the player with a free play of the wheel bonus game when the designated symbol accumulation area displays at least the designated quantity of the accumulated second designated symbols. In another such embodiment, each type of designated symbol is associated with a different designated symbol accumulation area such that the player may accumulate different designated symbols in different designated accumulation areas in each play of the game.

It should be appreciated that, in various embodiments: (a) the primary wagering game may be associated with, and the gaming system may display, any suitable quantity of symbol display areas in any suitable configuration or arrangement; (b) the primary wagering game may be associated with, and the gaming system may display, any suitable quantity of paylines for the primary wagering game; (c) each of the displayed paylines may be associated with any suitable quantity of the symbol display areas and any suitable combination of the symbol display areas; (d) the gaming system may use any other suitable award determination other than a payline evaluation, such as a ways to win and/or a scatter pay award determination (as described below); (e) the gaming system may modify the paytable to reflect lower credit payouts when a wager that is less than the maximum wager is placed on a play of the primary wagering game; (f) the gaming system may employ suitable paytable including any suitable quantity of winning symbol combinations; (g) the gaming system may use any suitable combination of the symbols as a winning symbol combination; (h) the winning symbol combinations may be associated with any suitable credit payouts; (i) the gaming system may utilize any suitable quantity of paytables; (j) the gaming system may employ any suitable symbols including, for example, any suitable markings or indicia such as letters, numbers, or illustrations or pictures of objects; and (k) the designated symbol accumulation area may include any suitable quantity of designated symbol display areas arranged in any suitable configuration.

In one embodiment, the gaming system randomly accumulates one or more designated symbols independent of any plays of any games. In another embodiment, the gaming system enables a player to purchase designated symbols to accumulate (i.e., to add to the designated symbol accumulation area). In one such embodiment, the gaming system enables the player to do so using player tracking points or credits. In another such embodiment, the gaming system enables the player to do so using other types of non-monetary credits. In another embodiment, the gaming system splits one or more designated symbols displayed in the designated symbol accumulation area into two or more designated symbols upon an occurrence of a designated symbol split event, which may be any suitable event.

In certain embodiments, the designated symbol accumulation event occurs when: (a) the designated symbol is generated and displayed along a wagered-on payline, (b) the designated symbol is generated and displayed and is part of a winning symbol combination, (c) the displayed symbols form a designated symbol combination, (d) a designated quantity of at least two of the designated symbol is generated and displayed, (e) the designated symbol is generated and displayed at a designated symbol display area, or (f) any suitable combination thereof.

In one embodiment, the designated symbol accumulation event occurs based on an outcome associated with one or more plays of any primary game and/or an outcome associated with one or more plays of any secondary game of the gaming system. In one such embodiment, such determinations are symbol driven or playing card driven based on the generation of one or more designated symbols, designated symbol combinations, designated playing cards, or designated playing card combinations.

In another embodiment, the gaming system does not provide any apparent reasons to the player for the occurrence of the designated symbol accumulation event. In these embodiments, such determinations are not triggered by an event in a primary game or based specifically on any of the plays of any primary game or on any of the plays of any secondary game of the gaming system. That is, such events occur without any explanation or alternatively with simple explanations.

In one embodiment, the designated symbol accumulation event occurs based on an amount of coin-in. In this embodiment, the gaming system determines if an amount of coin-in wagered at one or more gaming systems reaches or exceeds a designated amount of coin-in (i.e., a threshold coin-in amount). Upon the amount of coin-in wagered at one or more gaming systems reaching or exceeding the bonus threshold coin-in amount, the gaming system causes such an event to occur. In different embodiments, the threshold coin-in amount is predetermined, randomly determined, determined based on a player's status (such as determined through a player tracking system), determined based on a generated symbol or symbol combination, determined based on a random determination by the gaming system, determined based on one or more side wagers placed, determined based on the player's primary game wager, determined based on time (such as the time of day), or determined based on any other suitable method or criteria.

In another embodiment, the designated symbol accumulation event occurs based on an amount of coin-out. In this embodiment, the gaming system determines if an amount of coin-out provided by one or more gaming systems reaches or exceeds a designated amount of coin-out (i.e., a threshold coin-out amount). Upon the amount of coin-out provided at one or more gaming systems reaching or exceeding the threshold coin-out amount, the gaming system causes such an event to occur. In different embodiments, the threshold coin-out amount is predetermined, randomly determined, determined based on a player's status (such as determined through a player tracking system), determined based on a generated symbol or symbol combination, determined based on a random determination by the gaming system, determined based on one or more side wagers placed, determined based on the player's primary game wager, determined based on time (such as the time of day), or determined based on any other suitable method or criteria.

In another embodiment, the designated symbol accumulation event occurs based on a predefined variable reaching a defined parameter threshold. For example, when the 500,000 play of a game has been played on a gaming system (ascertained from a player tracking system), the gaming system causes such an event to occur. In different embodiments, the predefined parameter thresholds include a length of time, a length of time after a certain dollar amount is hit, a wager level threshold for a specific gaming system (e.g., which of a plurality of gaming systems is the first to contribute $250,000), a number of gaming systems active, or any other parameter that defines a suitable threshold.

In another embodiment, the designated symbol accumulation event occurs based on a quantity of games played. In this embodiment, a quantity of games played is set for when such an event will occur. In one embodiment, such a set quantity of games played is based on historic data.

In another embodiment, the designated symbol accumulation event occurs based on time. In this embodiment, a time is set for when such an event will occur. In one embodiment, such a set time is based on historic data.

In another embodiment, the designated symbol accumulation event occurs based upon gaming system operator defined player eligibility parameters stored on a player tracking system (such as via a player tracking card or other suitable manner). In this embodiment, the parameters for eligibility are defined by the gaming system operator based on any suitable criterion. In one embodiment, the gaming system recognizes the player's identification (via the player tracking system) when the player inserts or otherwise associates their player tracking card in the gaming system. The gaming system determines the player tracking level of the player and if the current player tracking level defined by the gaming system operator is eligible for such an event. In one embodiment; the gaming system operator defines minimum bet levels required for such an event to occur based on the player's card level.

In another embodiment, the designated symbol accumulation event occurs based on a system determination, including one or more random selections by a central controller, central server, or remote host (as further described below). In one embodiment, as described above, the central controller, central server, or remote host tracks all active gaming systems and the wagers placed on those gaming systems. In one such embodiment, based on the gaming system's state as well as one or more wager pools associated with the gaming system, the central controller, central server, or remote host determines whether such an event will occur. In one such embodiment, the player who consistently places a higher wager is more likely to be associated with an occurrence of such an event than a player who consistently places a minimum wager. It should be appreciated that the criteria for determining whether a player is in active status or inactive status for determining if such an event will occur may the same as, substantially the same as, or different than the criteria for determining whether a player is in active status or inactive status for another event to occur.

In another embodiment, the designated symbol accumulation event occurs based on a determination of whether any numbers allotted to a gaming system match a randomly selected number. In this embodiment, upon or prior to each play of each gaming system, a gaming system selects a random number from a range of numbers and during each primary game, the gaming system allocates the first N numbers in the range, where N is the number of credits bet by the player in that primary game. At the end of the primary game, the randomly selected number is compared with the numbers allocated to the player and if a match occurs, such an event occurs. It should be appreciated that any suitable manner of causing a progressive award contribution rate reconfiguration event to occur, and/or causing a progressive award triggering event to occur may be implemented in accordance with the gaming system and method disclosed herein.

It should be appreciated that any of the above-described designated symbol accumulation events may be combined in one or more different embodiments.

It should be appreciated that, in different embodiments, one or more of the additional award opportunities include, but are not limited to: a modifier such as a multiplier, a play of any suitable slot game, a play of any suitable free spins or free activations game, a play of any suitable wheel game, a play of any suitable card game, a play of any suitable offer and acceptance game, a play of any suitable award ladder game, a play of any suitable puzzle-type game, a play of any suitable persistence game, a play of any suitable selection game, a play of any suitable cascading symbols game, a play of any suitable ways to win game, a play of any suitable scatter pay game, a play of any suitable coin-pusher game, a play of any suitable elimination game, a play of any suitable stacked wilds game, a play of any suitable trail game, a play of any suitable bingo game, a play of any suitable video scratch-off game, a play of any suitable pick-until-complete game, a play of any suitable shooting simulation game, a play of any suitable racing game, a play of any suitable promotional game, a play of any suitable high-low game, a play of any suitable lottery game, a play of any suitable number selection game, a play of any suitable dice game, a play of any suitable skill game, a play of any suitable auction game, a play of any suitable reverse-auction game, a play of any suitable group game a play of any other suitable type of game, an award of monetary credits or currency, an award of nonmonetary credits, an award of player tracking credits or points, an award of a physical prize such as a car, or a comp award such as a free night's stay in a hotel room.

In one embodiment, the gaming system requires the player to place a side wager or pay a fee to enable the designated symbol accumulation feature. In another embodiment, the gaming system requires the player to place at least a designated wager, such as a maximum wager, to enable the designated symbol accumulation feature.

In another embodiment, the gaming system includes a persistence feature that, for a given player, saves any accumulated designated symbols for use in a future play of the game. For example, if a player terminates a gaming session while two accumulated designated symbols are displayed in the designated symbol accumulation area, the gaming system saves those accumulated designated symbols and, upon an initiation of a new gaming session for that player, displays those accumulated designated symbols in the designated symbol accumulation area. It should thus be appreciated that, in this embodiment, the player may play the game and accumulate designated symbols without risking losing those accumulated designated symbols upon termination of a gaming session.

It should be appreciated that the present disclosure contemplates enabling symbols to be accumulated in conjunction with any suitable game, such as a slot-type game (as described above), a card game, a wheel game, or a selection game. In one example embodiment, the gaming system is configured to operate a game associated with a wheel including a plurality of sections, each of which is associated with a symbol. For each play of the game, the gaming system spins the wheel and indicates one of the sections of the wheel. The gaming system displays the symbol associated with the indicated section at a symbol accumulation area (La, accumulates that symbol). The gaming system removes that accumulated symbol from the symbol accumulation area following an expiration event such as an expiration of a designated period associated with that accumulated designated symbol. Put differently, after indicating one of the sections of the wheel, the gaming system displays the symbol associated with the indicated section at the symbol accumulation area (La, accumulates that symbol), monitors whether the designated period associated with that accumulated symbol has expired, and removes that accumulated symbol from the symbol accumulation area following the expiration of the designated period (i.e., following the expiration event). Upon an occurrence of an additional award opportunity triggering event associated with any accumulated symbols displayed at the symbol accumulation area, the gaming system provides an additional award opportunity. In this example, the gaming system provides an award if three related symbols are simultaneously displayed at the symbol accumulation area.

It should also be appreciated that the present disclosure contemplates a cooperative multi-player game that enables a plurality of players to work together to accumulate symbols in a symbol accumulation area. In one example, players take turns spinning a wheel as described above (or playing any other suitable game) to accumulate a symbol in the symbol accumulation area. In certain such embodiments, the gaming system provides each player who participates in the multi-player game a portion of any awards provided based on any accumulated symbols. In other such embodiments, the gaming system provides each player who has accumulated a symbol that causes an award to be provided with a portion of that award.

Gaming Systems

It should be appreciated that the above-described embodiments of the present disclosure may be implemented in accordance with or in conjunction with one or more of a variety of different types of gaming systems, such as, but not limited to, those described below.

The present disclosure contemplates a variety of different gaming systems each having one or more of a plurality of different features, attributes, or characteristics. It should be appreciated that a "gaming system" as used herein refers to various configurations of: (a) one or more central servers, central controllers, or remote hosts; (b) one or more electronic gaming machines (EGMs); and/or (c) one or more personal gaming devices, such as desktop computers, laptop computers, tablet computers or computing devices, personal digital assistants (PDAs), mobile telephones such as smart phones, and other mobile computing devices.

Thus, in various embodiments, the gaming system of the present disclosure includes: (a) one or more EGMs in combination with one or more central servers, central controllers, or remote hosts; (b) one or more personal gaming devices in combination with one or more central servers, central controllers, or remote hosts; (c) one or more personal gaming devices in combination with one or more EGMs; (d) one or more personal gaming devices, one or more EGMs, and one or more central servers, central controllers, or remote hosts in combination with one another; (e) a single EGM; (f) a plurality of EGMs in combination with one another; (g) a single personal gaming device; (h) a plurality of personal gaming devices in combination with one another; (i) a single central server, central controller, or remote host; and/or (j) a plurality of central servers, central controllers, or remote hosts in combination with one another.

For brevity and clarity, each EGM and each personal gaming device of the present disclosure is collectively referred to herein as an "EGM." Additionally, for brevity and clarity, unless specifically stated otherwise, "EGM" as used herein represents one EGM or a plurality of EGMs, and "central server, central controller, or remote host" as used herein represents one central server, central controller, or remote host or a plurality of central servers, central controllers, or remote hosts.

Figure 3A:
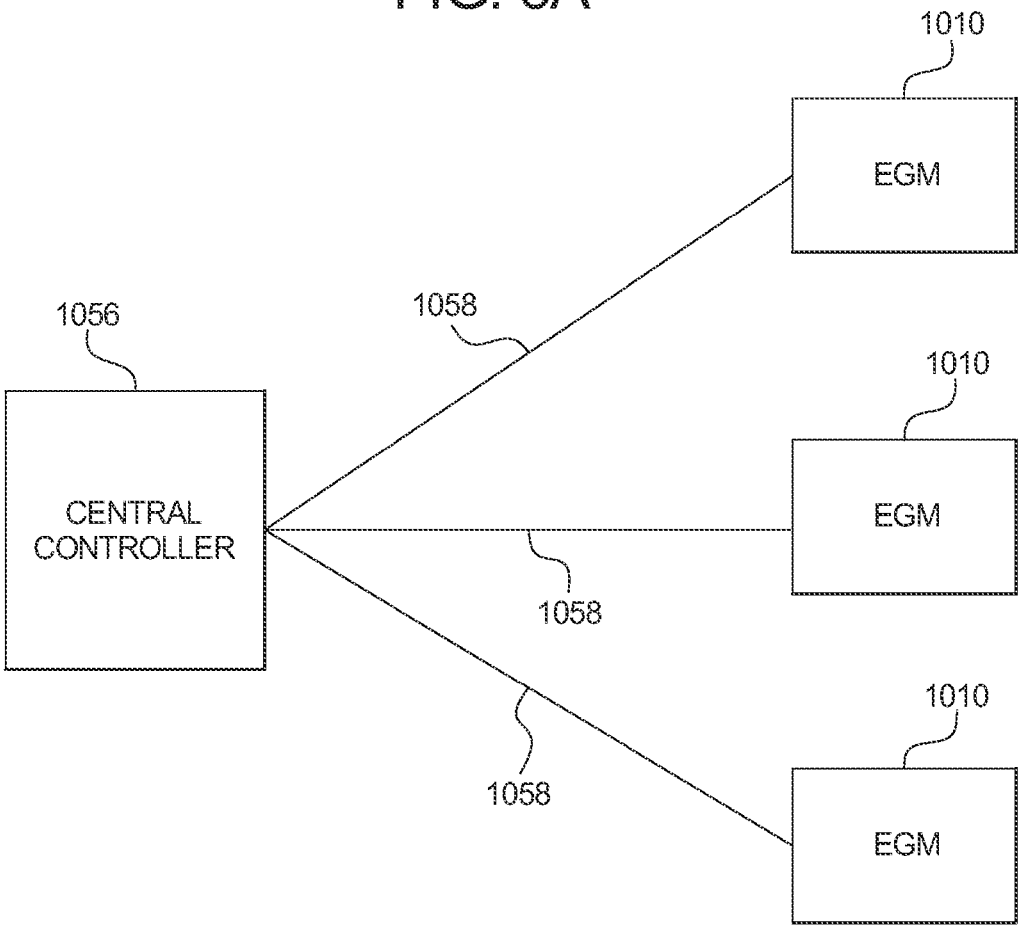
FIG. 3A is a schematic block diagram of one embodiment of a network configuration of the gaming system of the present disclosure.

As noted above, in various embodiments, the gaming system includes an EGM in combination with a central server, central controller, or remote host. In such embodiments, the EGM is configured to communicate with the central server, central controller, or remote host through a data network or remote communication link. In certain such embodiments, the EGM is configured to communicate with another EGM through the same data network or remote communication link or through a different data network or remote communication link. For example, the gaming system illustrated in FIG. 3A includes a plurality of EGMs 1010 that are each configured to communicate with a central server, central controller, or remote host 1056 through a data network 1058.

In certain embodiments in which the gaming system includes an EGM in combination with a central server, central controller, or remote host, the central server, central controller, or remote host is any suitable computing device (such as a server) that includes at least one processor and at least one memory device or storage device. As further described below, the EGM includes at least one EGM processor configured to transmit and receive data or signals representing events, messages, commands, or any other suitable information between the EGM and the central server, central controller, or remote host. The at least one processor of that EGM is configured to execute the events, messages, or commands represented by such data or signals in conjunction with the operation of the EGM. Moreover, the at least one processor of the central server, central controller, or remote host is configured to transmit and receive data or signals representing events, messages, commands, or any other suitable information between the central server, central controller, or remote host and the EGM. The at least one processor of the central server, central controller, or remote host is configured to execute the events, messages, or commands represented by such data or signals in conjunction with the operation of the central server, central controller, or remote host. It should be appreciated that one, more, or each of the functions of the central server, central controller, or remote host may be performed by the at least one processor of the EGM. It should be further appreciated that one, more, or each of the functions of the at least one processor of the EGM may be performed by the at least one processor of the central server, central controller, or remote host.

In certain such embodiments, computerized instructions for controlling any games (such as any primary or base games and/or any secondary or bonus games) displayed by the EGM are executed by the central server, central controller, or remote host. In such "thin client" embodiments, the central server, central controller, or remote host remotely controls any games (or other suitable interfaces) displayed by the EGM, and the EGM is utilized to display such games (or suitable interfaces) and to receive one or more inputs or commands. In other such embodiments, computerized instructions for controlling any games displayed by the EGM are communicated from the central server, central controller, or remote host to the EGM and are stored in at least one memory device of the EGM. In such "thick client" embodiments, the at least one processor of the EGM executes the computerized instructions to control any games (or other suitable interfaces) displayed by the EGM.

In various embodiments in which the gaming system includes a plurality of EGMs, one or more of the EGMs are thin client EGMs and one or more of the EGMs are thick client EGMs. In other embodiments in which the gaming system includes one or more EGMs, certain functions of one or more of the EGMs are implemented in a thin client environment, and certain other functions of one or more of the EGMs are implemented in a thick client environment. In one such embodiment in which the gaming system includes an EGM and a central server, central controller, or remote host, computerized instructions for controlling any primary or base games displayed by the EGM are communicated from the central server, central controller, or remote host to the EGM in a thick client configuration, and computerized instructions for controlling any secondary or bonus games or other functions displayed by the EGM are executed by the central server, central controller, or remote host in a thin client configuration.

In certain embodiments in which the gaming system includes: (a) an EGM configured to communicate with a central server, central controller, or remote host through a data network; and/or (b) a plurality of EGMs configured to communicate with one another through a data network, the data network is a local area network (LAN) in which the EGMs are located substantially proximate to one another and/or the central server, central controller, or remote host. In one example, the EGMs and the central server, central controller, or remote host are located in a gaming establishment or a portion of a gaming establishment.

In other embodiments in which the gaming system includes: (a) an EGM configured to communicate with a central server, central controller, or remote host through a data network; and/or (b) a plurality of EGMs configured to communicate with one another through a data network, the data network is a wide area network (WAN) in which one or more of the EGMs are not necessarily located substantially proximate to another one of the EGMs and/or the central server, central controller, or remote host. For example, one or more of the EGMs are located: (a) in an area of a gaming establishment different from an area of the gaming establishment in which the central server, central controller, or remote host is located; or (b) in a gaming establishment different from the gaming establishment in which the central server, central controller, or remote host is located. In another example, the central server, central controller, or remote host is not located within a gaming establishment in which the EGMs are located. It should be appreciated that in certain embodiments in which the data network is a WAN, the gaming system includes a central server, central controller, or remote host and an EGM each located in a different gaming establishment in a same geographic area, such as a same city or a same state. It should be appreciated that gaming systems in which the data network is a WAN are substantially identical to gaming systems in which the data network is a LAN, though the quantity of EGMs in such gaming systems may vary relative to one another.

In further embodiments in which the gaming system includes: (a) an EGM configured to communicate with a central server, central controller, or remote host through a data network; and/or (b) a plurality of EGMs configured to communicate with one another through a data network, the data network is an internet or an intranet. In certain such embodiments, an internet browser of the EGM is usable to access an internet game page from any location where an internet connection is available. In one such embodiment, after the internet game page is accessed, the central server, central controller, or remote host identifies a player prior to enabling that player to place any wagers on any plays of any wagering games. In one example, the central server, central controller, or remote host identifies the player by requiring a player account of the player to be logged into via an input of a unique username and password combination assigned to the player. It should be appreciated, however, that the central server, central controller, or remote host may identify the player in any other suitable manner, such as by validating a player tracking identification number associated with the player; by reading a player tracking card or other smart card inserted into a card reader (as described below); by validating a unique player identification number associated with the player by the central server, central controller, or remote host; or by identifying the EGM, such as by identifying the MAC address or the IP address of the internet facilitator. In various embodiments, once the central server, central controller, or remote host identifies the player, the central server, central controller, or remote host enables placement of one or more wagers on one or more plays of one or more primary or base games and/or one or more secondary or bonus games, and displays those plays via the internet browser of the EGM.

It should be appreciated that the central server, central controller, or remote host and the EGM are configured to connect to the data network or remote communications link in any suitable manner. In various embodiments, such a connection is accomplished via: a conventional phone line or other data transmission line, a digital subscriber line (DSL), a T-1 line, a coaxial cable, a fiber optic cable, a wireless or wired routing device, a mobile communications network connection (such as a cellular network or mobile internet network), or any other suitable medium. It should be appreciated that the expansion in the quantity of computing devices and the quantity and speed of internet connections in recent years increases opportunities for players to use a variety of EGMs to play games from an ever-increasing quantity of remote sites. It should also be appreciated that the enhanced bandwidth of digital wireless communications may render such technology suitable for some or all communications, particularly if such communications are encrypted. Higher data transmission speeds may be useful for enhancing the sophistication and response of the display and interaction with players.

EGM Components

Figure 3B:
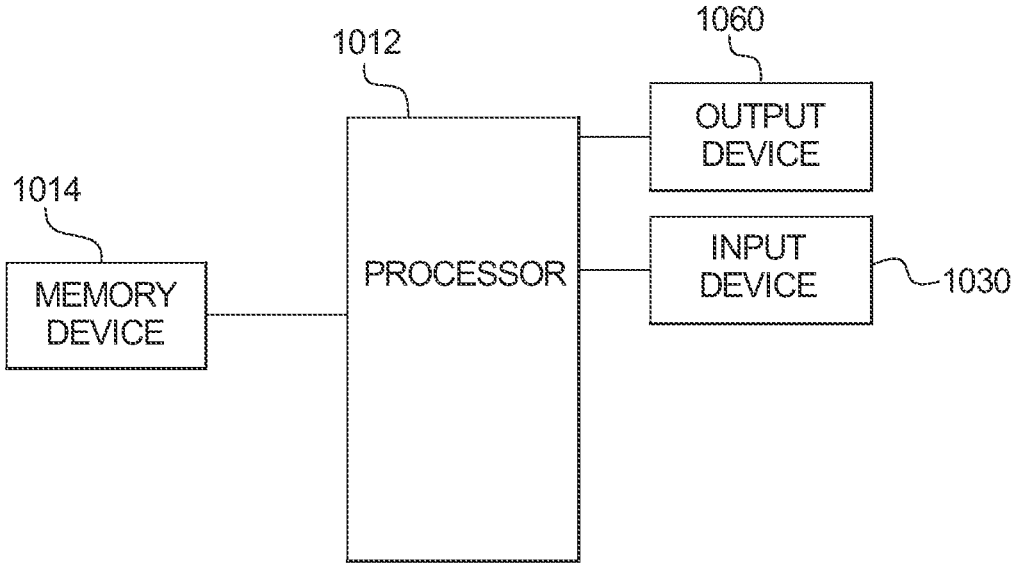
FIG. 3B is a schematic block diagram of an exar example electronic configuration of an EGM of the present disclosure.

In various embodiments, an EGM includes at least one processor configured to operate with at least one memory device, at least one input device, and at least one output device. The at least one processor may be any suitable processing device or set of processing devices, such as a microprocessor, a microcontroller-based platform, a suitable integrated circuit, or one or more application-specific integrated circuits (ASICs). FIG. 3B illustrates an example EGM including a processor 1012.

As generally noted above, the at least one processor of the EGM is configured to communicate with, configured to access, and configured to exchange signals with at least one memory device or data storage device. In various embodiments, the at least one memory device of the EGM includes random access memory (RAM), which can include non-volatile RAM (NVRAM), magnetic RAM (MRAM), ferro-electric RAM (FeRAM), and other forms as commonly understood in the gaming industry. In other embodiments, the at least one memory device includes read only memory (ROM). In certain embodiments, the at least one memory device of the EGM includes flash memory and/or EEPROM (electrically erasable programmable read only memory). The example EGM illustrated in FIG. 3B includes a memory device 1014. It should be appreciated that any other suitable magnetic, optical, and/or semiconductor memory may operate in conjunction with the EGM disclosed herein. In certain embodiments, the at least one processor of the EGM and the at least one memory device of the EGM both reside within a cabinet of the EGM (as described below). In other embodiments, at least one of the at least one processor of the EGM and the at least one memory device of the EGM reside outside the cabinet of the EGM (as described below).

In certain embodiments, as generally described above, the at least one memory device of the EGM stores program code and instructions executable by the at least one processor of the EGM to control the EGM. The at least one memory device of the EGM also stores other operating data, such as image data, event data, input data, random number generators (RNGs) or pseudo-RNGs, paytable data or information, and/or applicable game rules that relate to the play of one or more games on the EGM (such as primary or base games and/or secondary or bonus games as described below). In various embodiments, part or all of the program code and/or the operating data described above is stored in at least one detachable or removable memory device including, but not limited to, a cartridge, a disk, a CD ROM, a DVD, a USB memory device, or any other suitable non-transitory computer readable medium. In certain such embodiments, an operator (such as a gaming establishment operator) and/or a player uses such a removable memory device in an EGM to implement at least part of the present disclosure. In other embodiments, part or all of the program code and/or the operating data is downloaded to the at least one memory device of the EGM through any suitable data network described above (such as an internet or intranet).

Figure 4A:
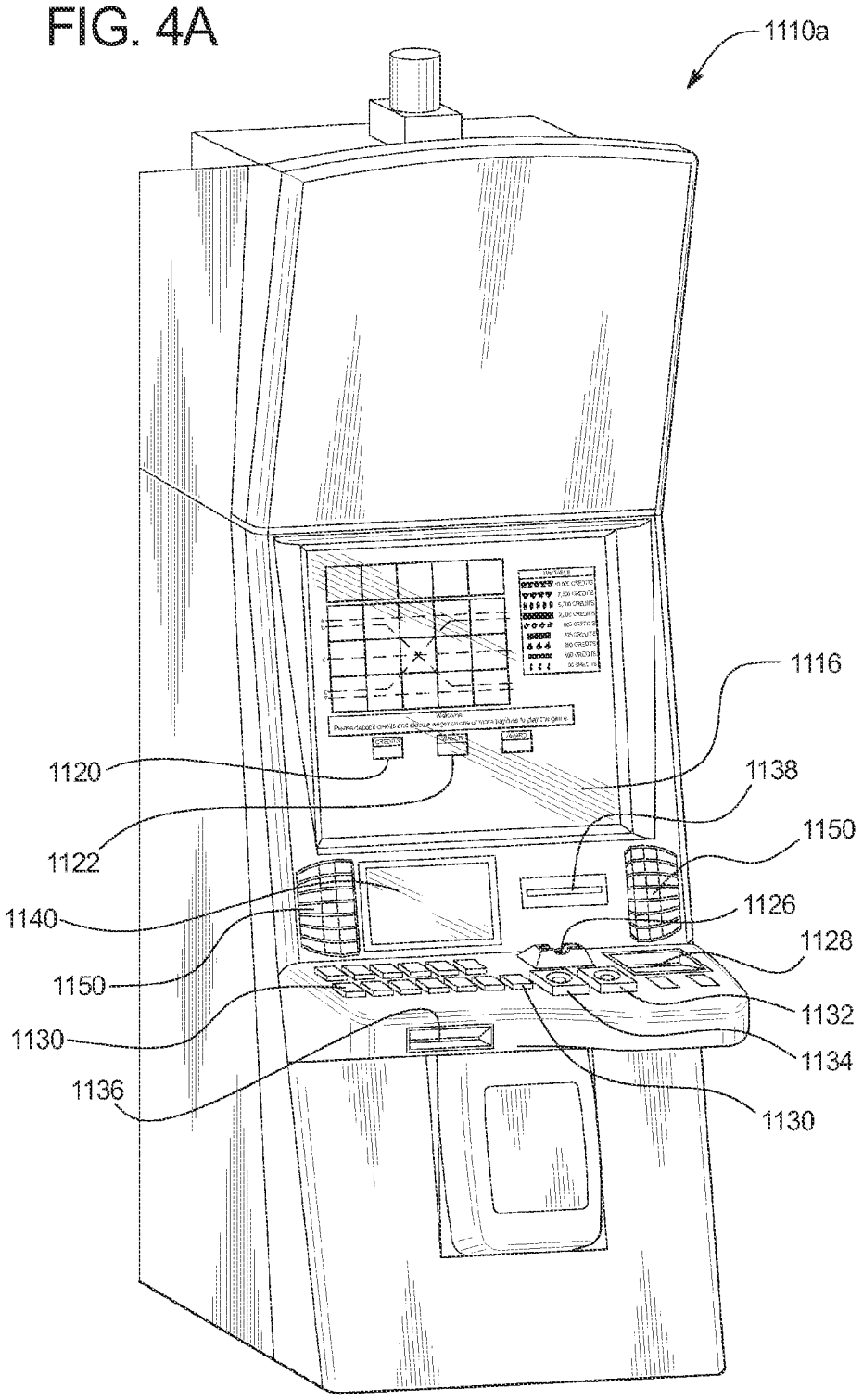
FIGS. 4A and 4B are perspective views of example alternative embodiments of EGMs of the present disclosure.
Figure 4B:
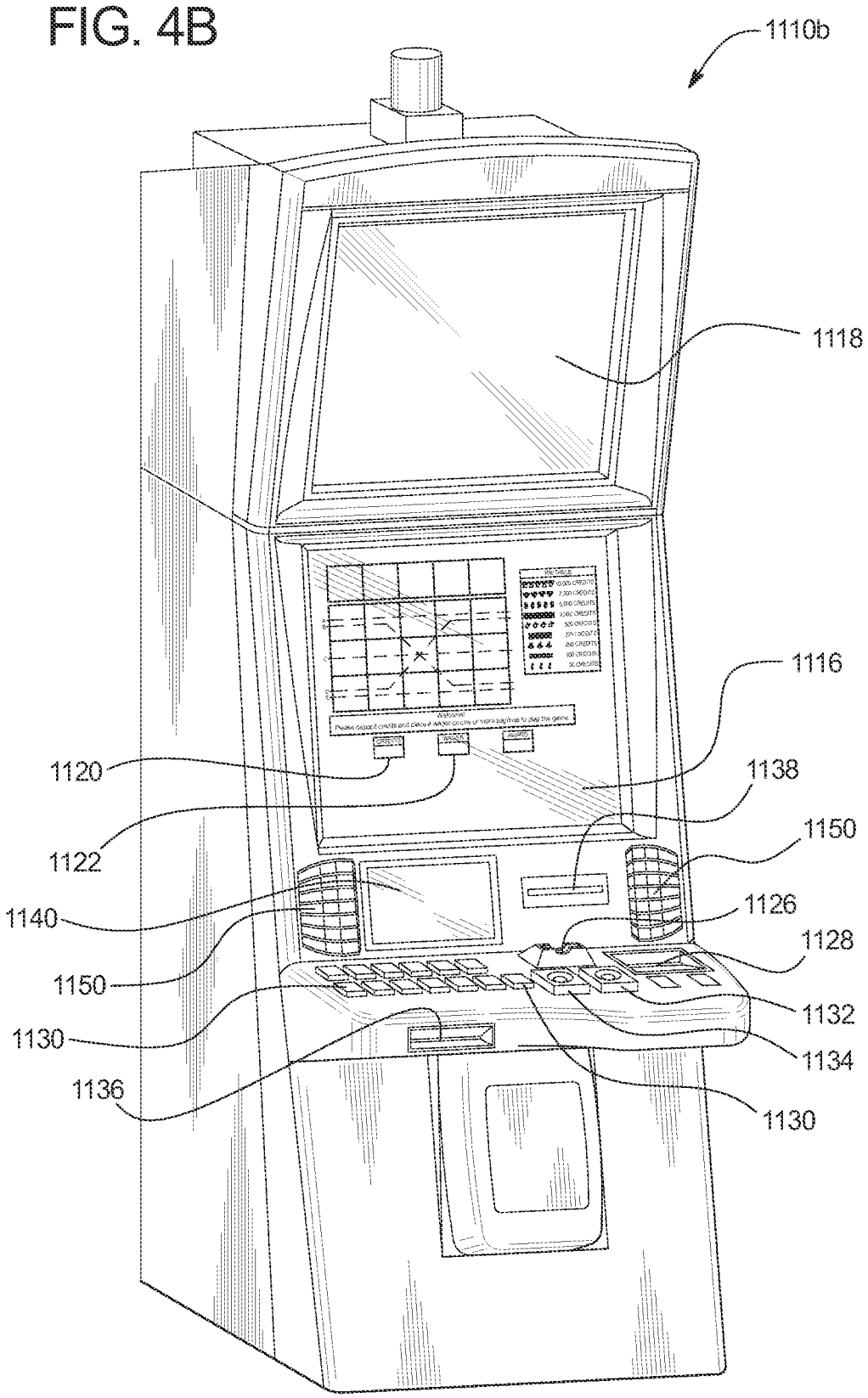

In various embodiments, the EGM includes one or more input devices. The input devices may include any suitable device that enables an input signal to be produced and received by the at least one processor of the EGM. The example EGM illustrated in FIG. 3B includes at least one input device 1030. One input device of the EGM is a payment device configured to communicate with the at least one processor of the EGM to fund the EGM. In certain embodiments, the payment device includes one or more of: (a) a bill acceptor into which paper money is inserted to fund the EGM; (b) a ticket acceptor into which a ticket or a voucher is inserted to fund the EGM; (c) a coin slot into which coins or tokens are inserted to fund the EGM; (d) a reader or a validator for credit cards, debit cards, or credit slips into which a credit card, debit card, or credit slip is inserted to fund the EGM; (e) a player identification card reader into which a player identification card is inserted to fund the EGM; or (f) any suitable combination thereof. FIGS. 4A and 4B illustrate example EGMs that each include the following payment devices: (a) a combined bill and ticket acceptor 1128, and (b) a coin slot 1126.

In one embodiment, the EGM includes a payment device configured to enable the EGM to be funded via an electronic funds transfer, such as a transfer of funds from a bank account. In another embodiment, the EGM includes a payment device configured to communicate with a mobile device of a player, such as a cell phone, a radio frequency identification tag, or any other suitable wired or wireless device, to retrieve relevant information associated with that player to fund the EGM. It should be appreciated that when the EGM is funded, the at least one processor determines the amount of funds entered and displays the corresponding amount on a credit display or any other suitable display as described below.

In various embodiments, one or more input devices of the EGM are one or more game play activation devices that are each used to initiate a play of a game on the EGM or a sequence of events associated with the EGM following appropriate funding of the EGM. The example EGMs illustrated in FIGS. 4A and 4B each include a game play activation device in the form of a game play initiation button 32. It should be appreciated that, in other embodiments, the EGM begins game play automatically upon appropriate funding rather than upon utilization of the game play activation device.

In certain embodiments, one or more input devices of the EGM are one or more wagering or betting devices. One such wagering or betting device is as a maximum wagering or betting device that, when utilized, causes a maximum wager to be placed. Another such wagering or betting device is a repeat the bet device that, when utilized, causes the previously-placed wager to be placed. A further such wagering or betting device is a bet one device. A bet is placed upon utilization of the bet one device. The bet is increased by one credit each time the bet one device is utilized. Upon the utilization of the bet one device, a quantity of credits shown in a credit display (as described below) decreases by one, and a number of credits shown in a bet display (as described below) increases by one.

In other embodiments, one input device of the EGM is a cash out device. The cash out device is utilized to receive a cash payment or any other suitable form of payment corresponding to a quantity of remaining credits of a credit display (as described below). The example EGMs illustrated in FIGS. 4A and 4B each include a cash out device in the form of a cash out button 1134.

In certain embodiments, one input device of the EGM is a touch-screen coupled to a touch-screen controller or other touch-sensitive display overlay to enable interaction with any images displayed on a display device (as described below). One such input device is a conventional touch-screen button panel. The touch-screen and the touch-screen controller are connected to a video controller. In these embodiments, signals are input to the EGM by touching the touch screen at the appropriate locations.

In various embodiments, one input device of the EGM is a sensor, such as a camera, in communication with the at least one processor of the EGM (and controlled by the at least one processor of the EGM in some embodiments) and configured to acquire an image or a video of a player using the EGM and/or an image or a video of an area surrounding the EGM.

In embodiments including a player tracking system, as further described below, one input device of the EGM is a card reader in communication with the at least one processor of the EGM. The example EGMs illustrated in FIGS. 4A and 4B each include a card reader 1138. The card reader is configured to read a player identification card inserted into the card reader.

In various embodiments, the EGM includes one or more output devices. The example EGM illustrated in FIG. 3B includes at least one output device 1060. One or more output devices of the EGM are one or more display devices configured to display any game(s) displayed by the EGM and any suitable information associated with such game(s). In certain embodiments, the display devices are connected to or mounted on a cabinet of the EGM (as described below). In various embodiments, the display devices serves as digital glass configured to advertise certain games or other aspects of the gaming establishment in which the EGM is located. In various embodiments, the EGM includes one or more of the following display devices: (a) a central display device; (b) a player tracking display configured to display various information regarding a player's player tracking status (as described below); (c) a secondary or upper display device in addition to the central display device and the player tracking display; (d) a credit display configured to display a current quantity of credits, amount of cash, account balance, or the equivalent; and (e) a bet display configured to display an amount wagered for one or more plays of one or more games. The example EGM illustrated in FIG. 4A includes a central display device 1116, a player tracking display 1140, a credit display 1120, and a bet display 1122. The example EGM illustrated in FIG. 4B includes a central display device 1116, an upper display device 1118, a player tracking display 1140, a player tracking display 1140, a credit display 1120, and a bet display 1122.

In various embodiments, the display devices include, without limitation: a monitor, a television display, a plasma display, a liquid crystal display (LCD), a display based on light emitting diodes (LEDs), a display based on a plurality of organic light-emitting diodes (OLEDs), a display based on polymer light-emitting diodes (PLEDs), a display based on a plurality of surface-conduction electron-emitters (SEDs), a display including a projected and/or reflected image, or any other suitable electronic device or display mechanism. In certain embodiments, as described above, the display device includes a touch-screen with an associated touch-screen controller. It should be appreciated that the display devices may be of any suitable sizes, shapes, and configurations.

The display devices of the EGM are configured to display one or more game and/or non-game images, symbols, and indicia. In certain embodiments, the display devices of the EGM are configured to display any suitable visual representation or exhibition of the movement of objects; dynamic lighting; video images; images of people, characters, places, things, and faces of cards; and the like. In certain embodiments, the display devices of the EGM are configured to display one or more video reels, one or more video wheels, and/or one or more video dice. In other embodiments, certain of the displayed images, symbols, and indicia are in mechanical form. That is, in these embodiments, the display device includes any electromechanical device, such as one or more rotatable wheels, one or more reels, and/or one or more dice, configured to display at least one or a plurality of game or other suitable images, symbols, or indicia.

In various embodiments, one output device of the EGM is a payout device. In these embodiments, when the cash out device is utilized as described above, the payout device causes a payout to be provided to the player. In one embodiment, the payout device is one or more of: (a) a ticket generator configured to generate and provide a ticket or credit slip representing a payout, wherein the ticket or credit slip may be redeemed via a cashier, a kiosk, or other suitable redemption system; (b) a note generator configured to provide paper currency; (c) a coin generator configured to provide coins or tokens in a coin payout tray; and (d) any suitable combination thereof. The example EGMs illustrated in FIGS. 4A and 4B each include ticket generator 1136. In one embodiment, the EGM includes a payout device configured to fund an electronically recordable identification card or smart card or a bank account via an electronic funds transfer.

In certain embodiments, one output device of the EGM is a sound generating device controlled by one or more sound cards. In one such embodiment, the sound generating device includes one or more speakers or other sound generating hardware and/or software for generating sounds, such as by playing music for any games or by playing music for other modes of the EGM, such as an attract mode. The example EGMs illustrated in FIGS. 4A and 4B each include a plurality of speakers 1150. In another such embodiment, the EGM provides dynamic sounds coupled with attractive multimedia images displayed on one or more of the display devices to provide an audio-visual representation or to otherwise display full-motion video with sound to attract players to the EGM. In certain embodiments, the EGM displays a sequence of audio and/or visual attraction messages during idle periods to attract potential players to the EGM. The videos may be customized to provide any appropriate information.

In various embodiments, the EGM includes a plurality of communication ports configured to enable the at least one processor of the EGM to communicate with and to operate with external peripherals, such as: accelerometers, arcade sticks, bar code readers, bill validators, biometric input devices, bonus devices, button panels, card readers, coin dispensers, coin hoppers, display screens or other displays or video sources, expansion buses, information panels, keypads, lights, mass storage devices, microphones, motion sensors, motors, printers, reels, SCSI ports, solenoids, speakers, thumbsticks, ticket readers, touch screens, trackballs, touchpads, wheels, and wireless communication devices. At least U.S. Patent Application Publication No. 2004/0254014 describes a variety of EGMs including one or more communication ports that enable the EGMs to communicate and operate with one or more external peripherals.

As generally described above, in certain embodiments, such as the example EGMs illustrated in FIGS. 4A and 4B, the EGM has a support structure, housing, or cabinet that provides support for a plurality of the input device and the output devices of the EGM. Further, the EGM is configured such that a player may operate it while standing or sitting. In various embodiments, the EGM is positioned on a base or stand, or is configured as a pub-style tabletop game (not shown) that a player may operate typically while sitting. As illustrated by the different example EGMs shown in FIGS. 4A and 4B, EGMs may have varying cabinet and display configurations.

It should be appreciated that, in certain embodiments, the EGM is a device that has obtained approval from a regulatory gaming commission, and in other embodiments, the EGM is a device that has not obtained approval from a regulatory gaming commission.

As explained above, for brevity and clarity, both the EGMs and the personal gaming devices of the present disclosure are collectively referred to herein as "EGMs." Accordingly, it should be appreciated that certain of the example EGMs described above include certain elements that may not be included in all EGMs. For example, the payment device of a personal gaming device such as a mobile telephone may not include a coin acceptor, while in certain instances the payment device of an EGM located in a gaming establishment may include a coin acceptor.

Operation of Primary or Base Games and/or Secondary or Bonus Games

In various embodiments, an EGM may be implemented in one of a variety of different configurations. In various embodiments, the EGM may be implemented as one of: (a) a dedicated EGM wherein computerized game programs executable by the EGM for controlling any primary or base games (referred to herein as "primary games") and/or any secondary or bonus games or other functions (referred to herein as "secondary games") displayed by the EGM are provided with the EGM prior to delivery to a gaming establishment or prior to being provided to a player; and (b) a changeable EGM wherein computerized game programs executable by the EGM for controlling any primary games and/or secondary games displayed by the EGM are downloadable to the EGM through a data network or remote communication link after the EGM is physically located in a gaming establishment or after the EGM is provided to a player.

As generally explained above, in various embodiments in which the gaming system includes a central server, central controller, or remote host and a changeable EGM, the at least one memory device of the central server, central controller, or remote host stores different game programs and instructions executable by the at least one processor of the changeable EGM to control one or more primary games and/or secondary games displayed by the changeable EGM. More specifically, each such executable game program represents a different game or a different type of game that the at least one changeable EGM is configured to operate. In one example, certain of the game programs are executable by the changeable EGM to operate games having the same or substantially the same game play but different paytables. In different embodiments, each executable game program is associated with a primary game, a secondary game, or both. In certain embodiments, an executable game program is executable by the at least one processor of the at least one changeable EGM as a secondary game to be played simultaneously with a play of a primary game (which may be downloaded to or otherwise stored on the at least one changeable EGM), or vice versa.

In operation of such embodiments, the central server, central controller, or remote host is configured to communicate one or more of the stored executable game programs to the at least one processor of the changeable EGM. In different embodiments, a stored executable game program is communicated or delivered to the at least one processor of the changeable EGM by: (a) embedding the executable game program in a device or a component (such as a microchip to be inserted into the changeable EGM); (b) writing the executable game program onto a disc or other media; or (c) uploading or streaming the executable game program over a data network (such as a dedicated data network). After the executable game program is communicated from the central server, central controller, or remote host to the changeable EGM, the at least one processor of the changeable EGM executes the executable game program to enable the primary game and/or the secondary game associated with that executable game program to be played using the display device(s) and/or the input device(s) of the changeable EGM. That is, when an executable game program is communicated to the at least one processor of the changeable EGM, the at least one processor of the changeable EGM changes the game or the type of game that may be played using the changeable EGM.

In certain embodiments, the gaming system randomly determines any game outcome(s) (such as a win outcome) and/or award(s) (such as a quantity of credits to award for the win outcome) for a play of a primary game and/or a play of a secondary game based on probability data. In certain such embodiments, this random determination is provided through utilization of an RNG, such as a true RNG or a pseudo RNG, or any other suitable randomization process. In one such embodiment, each game outcome or award is associated with a probability, and the gaming system generates the game outcome(s) and/or the award(s) to be provided based on the associated probabilities. In these embodiments, since the gaming system generates game outcomes and/or awards randomly or based on one or more probability calculations, there is no certainty that the gaming system will ever provide any specific game outcome and/or award.

In certain embodiments, the gaming system maintains one or more predetermined pools or sets of predetermined game outcomes and/or awards. In certain such embodiments, upon generation or receipt of a game outcome and/or award request, the gaming system independently selects one of the predetermined game outcomes and/or awards from the one or more pools or sets. The gaming system flags or marks the selected game outcome and/or award as used. Once a game outcome or an award is flagged as used, it is prevented from further selection from its respective pool or set: that is, the gaming system does not select that game outcome or award upon another game outcome and/or award request. The gaming system provides the selected game outcome and/or award. At least U.S. Pat. Nos. 7,470,183; 7,563,163; and 7,833,092 and U.S. Patent Application Publication Nos. 2005/0148382, 2006/0094509, and 2009/0181743 describe various examples of this type of award determination.

In certain embodiments, the gaming system determines a predetermined game outcome and/or award based on the results of a bingo, keno, or lottery game. In certain such embodiments, the gaming system utilizes one or more bingo, keno, or lottery games to determine the predetermined game outcome and/or award provided for a primary game and/or a secondary game. The gaming system is provided or associated with a bingo card. Each bingo card consists of a matrix or array of elements, wherein each element is designated with separate indicia. After a bingo card is provided, the gaming system randomly selects or draws a plurality of the elements. As each element is selected, a determination is made as to whether the selected element is present on the bingo card. If the selected element is present on the bingo card, that selected element on the provided bingo card is marked or flagged. This process of selecting elements and marking any selected elements on the provided bingo cards continues until one or more predetermined patterns are marked on one or more of the provided bingo cards. After one or more predetermined patterns are marked on one or more of the provided bingo cards, game outcome and/or award is determined based, at least in part, on the selected elements on the provided bingo cards. At least U.S. Pat. Nos. 7,753,774; 7,731,581; 7,955,170; and 8,070,579 and U.S. Patent Application Publication No. 2011/0028201 describe various examples of this type of award determination.

In certain embodiments in which the gaming system includes a central server, central controller, or remote host and an EGM, the EGM is configured to communicate with the central server, central controller, or remote host for monitoring purposes only. In such embodiments, the EGM determines the game outcome(s) and/or award(s) to be provided in any of the manners described above, and the central server, central controller, or remote host monitors the activities and events occurring on the EGM. In one such embodiment, the gaming system includes a real-time or online accounting and gaming information system configured to communicate with the central server, central controller, or remote host. In this embodiment, the accounting and gaming information system includes: (a) a player database for storing player profiles, (b) a player tracking module for tracking players (as described below), and (c) a credit system for providing automated transactions. At least U.S. Pat. No. 6,913,534 and U.S. Patent Application Publication No. 2006/0281541 describe various examples of such accounting systems.

As noted above, in various embodiments, the gaming system includes one or more executable game programs executable by at least one processor of the gaming system to provide one or more primary games and one or more secondary games. The primary game(s) and the secondary game(s) may comprise any suitable games and/or wagering games, such as, but not limited to: electro-mechanical or video slot or spinning reel type games; video card games such as video draw poker, multi-hand video draw poker, other video poker games, video blackjack games, and video baccarat games; video keno games; video bingo games; and video selection games.

In certain embodiments in which the primary game is a slot or spinning reel type game, the gaming system includes one or more reels in either an electromechanical form with mechanical rotating reels or in a video form with simulated reels and movement thereof. Each reel displays a plurality of indicia or symbols, such as bells, hearts, fruits, numbers, letters, bars, or other images that typically correspond to a theme associated with the gaming system. In certain such embodiments, the gaming system includes one or more paylines associated with the reels. The example EGMs shown in FIGS. 4A and 4B each include a payline 1152 and a plurality of reels 1154. In certain embodiments, one or more of the reels are independent reels or unisymbol reels. In such embodiments, each independent reel generates and displays one symbol.

In various embodiments, one or more of the paylines is horizontal, vertical, circular, diagonal, angled, or any suitable combination thereof. In other embodiments, each of one or more of the paylines is associated with a plurality of adjacent symbol display areas on a requisite number of adjacent reels. In one such embodiment, one or more paylines are formed between at least two symbol display areas that are adjacent to each other by either sharing a common side or sharing a common corner (i.e., such paylines are connected paylines). The gaming system enables a wager to be placed on one or more of such paylines to activate such paylines. In other embodiments in which one or more paylines are formed between at least two adjacent symbol display areas, the gaming system enables a wager to be placed on a plurality of symbol display areas, which activates those symbol display areas.

In various embodiments, the gaming system provides one or more awards after a spin of the reels when specified types and/or configurations of the indicia or symbols on the reels occur on an active payline or otherwise occur in a winning pattern, occur on the requisite number of adjacent reels, and/or occur in a scatter pay arrangement.

In certain embodiments, the gaming system employs a ways to win award determination. In these embodiments, any outcome to be provided is determined based on a number of associated symbols that are generated in active symbol display areas on the requisite number of adjacent reels (i.e., not on paylines passing through any displayed winning symbol combinations). If a winning symbol combination is generated on the reels, one award for that occurrence of the generated winning symbol combination is provided. At least U.S. Pat. No. 8,012,011 and U.S. Patent Application Publication Nos. 2008/0108408 and 2008/0132320 describe various examples of ways to win award determinations.

In various embodiments, the gaming system includes a progressive award. Typically, a progressive award includes an initial amount and an additional amount funded through a portion of each wager placed to initiate a play of a primary game. When one or more triggering events occurs, the gaming system provides at least a portion of the progressive award. After the gaming system provides the progressive award, an amount of the progressive award is reset to the initial amount and a portion of each subsequent wager is allocated to the next progressive award. At least U.S. Pat. Nos. 5,766,079; 7,585,223; 7,651,392; 7,666,093; 7,780,523; and 7,905,778 and U.S. Patent Application Publication Nos. 200810020846, 2009/0123364, 2009/0123363, and 2010/0227677 describe various examples of different progressive gaming systems.

As generally noted above, in addition to providing winning credits or other awards for one or more plays of the primary game(s), in various embodiments the gaming system provides credits or other awards for one or more plays of one or more secondary games. The secondary game typically enables a prize or payout in to be obtained addition to any prize or payout obtained through play of the primary game(s). The secondary game(s) typically produces a higher level of player excitement than the primary game(s) because the secondary game(s) provides a greater expectation of winning than the primary game(s) and is accompanied with more attractive or unusual features than the primary game(s). It should be appreciated that the secondary game(s) may be any type of suitable game, either similar to or completely different from the primary game.

In various embodiments, the gaming system automatically provides or initiates the secondary game upon the occurrence of a triggering event or the satisfaction of a qualifying condition. In other embodiments, the gaming system initiates the secondary game upon the occurrence of the triggering event or the satisfaction of the qualifying condition and upon receipt of an initiation input. In certain embodiments, the triggering event or qualifying condition is a selected outcome in the primary game(s) or a particular arrangement of one or more indicia on a display device for a play of the primary game(s), such as a "BONUS" symbol appearing on three adjacent reels along a payline following a spin of the reels for a play of the primary game. In other embodiments, the triggering event or qualifying condition occurs based on a certain amount of game play (such as number of games, number of credits, amount of time) being exceeded, or based on a specified number of points being earned during game play. It should be appreciated that any suitable triggering event or qualifying condition or any suitable combination of a plurality of different triggering events or qualifying conditions may be employed.

In other embodiments, at least one processor of the gaming system randomly determines when to provide one or more plays of one or more secondary games. In one such embodiment, no apparent reason is provided for the providing of the secondary game. In this embodiment, qualifying for a secondary game is not triggered by the occurrence of an event in any primary game or based specifically on any of the plays of any primary game. That is, qualification is provided without any explanation or, alternatively, with a simple explanation. In another such embodiment, the gaming system determines qualification for a secondary game at least partially based on a game triggered or symbol triggered event, such as at least partially based on play of a primary game.

In various embodiments, after qualification for a secondary game has been determined, the secondary game participation may be enhanced through continued play on the primary game. Thus, in certain embodiments, for each secondary game qualifying event, such as a secondary game symbol, that is obtained, a given number of secondary game wagering points or credits is accumulated in a "secondary game meter" configured to accrue the secondary game wagering credits or entries toward eventual participation in the secondary game. In one such embodiment, the occurrence of multiple such secondary game qualifying events in the primary game results in an arithmetic or exponential increase in the number of secondary game wagering credits awarded. In another such embodiment, any extra secondary game wagering credits may be redeemed during the secondary game to extend play of the secondary game.

In certain embodiments, no separate entry fee or buy-in for the secondary game is required. That is, entry into the secondary game cannot be purchased; rather, in these embodiments entry must be won or earned through play of the primary game, thereby encouraging play of the primary game. In other embodiments, qualification for the secondary game is accomplished through a simple "buy-in." For example, qualification through other specified activities is unsuccessful, payment of a fee or placement of an additional wager "buys-in" to the secondary game. In certain embodiments, a separate side wager must be placed on the secondary game or a wager of a designated amount must be placed on the primary game to enable qualification for the secondary game. In these embodiments, the secondary game triggering event must occur and the side wager (or designated primary game wager amount) must have been placed for the secondary game to trigger.

In various embodiments in which the gaming system includes a plurality of EGMs, the EGMs are configured to communicate with one another to provide a group gaming environment. In certain such embodiments, the EGMs enable players of those EGMs to work in conjunction with one another, such as by enabling the players to play together as a team or group, to win one or more awards. In other such embodiments, the EGMs enable players of those EGMs to compete against one another for one or more awards. In one such embodiment, the EGMs enable the players of those EGMs to participate in one or more gaming tournaments for one or more awards. At least U.S. Patent Application Publication Nos. 200710123341, 2008/0070680, 2008/0176650, and 2009/0124363 describe various examples of different group gaming systems.

In various embodiments, the gaming system includes one or more player tracking systems. Such player tracking systems enable operators of the gaming system (such as casinos or other gaming establishments) to recognize the value of customer loyalty by identifying frequent customers and rewarding them for their patronage. Such a player tracking system is configured to track a player's gaming activity. In one such embodiment, the player tracking system does so through the use of player tracking cards. In this embodiment, a player is issued a player identification card that has an encoded player identification number that uniquely identifies the player. When the player's playing tracking card is inserted into a card reader of the gaming system to begin a gaming session, the card reader reads the player identification number off the player tracking card to identify the player. The gaming system timely tracks any suitable information or data relating to the identified player's gaming session. The gaming system also timely tracks when the player tracking card is removed to conclude play for that gaming session. In another embodiment, rather than requiring insertion of a player tracking card into the card reader, the gaming system utilizes one or more portable devices, such as a cell phone, a radio frequency identification tag, or any other suitable wireless device, to track when a gaming session begins and ends. In another embodiment, the gaming system utilizes any suitable biometric technology or ticket technology to track when a gaming session begins and ends.

In such embodiments, during one or more gaming sessions, the gaming system tracks any suitable information or data, such as any amounts wagered, average wager amounts, and/or the time at which these wagers are placed. In different embodiments, for one or more players, the player tracking system includes the player's account number, the player's card number, the player's first name, the player's surname, the player's preferred name, the player's player tracking ranking, any promotion status associated with the player's player tracking card, the player's address, the player's birthday, the player's anniversary, the player's recent gaming sessions, or any other suitable data. In various embodiments, such tracked information and/or any suitable feature associated with the player tracking system is displayed on a player tracking display. In various embodiments, such tracked information and/or any suitable feature associated with the player tracking system is displayed via one or more service windows that are displayed on the central display device and/or the upper display device. At least U.S. Pat. Nos. 6,722,985; 6,908,387; 7,311,605; 7,611,411; 7,617,151; and 8,057,298 describe various examples of player tracking systems.

It should be understood that various changes and modifications to the present embodiments described herein will be apparent to those skilled in the art. Such changes and modifications can be made without departing from the spirit and scope of the present subject matter and without diminishing its intended advantages. It is therefore intended that such changes and modifications be covered by the appended claims.

The invention is claimed as follows:

1. A gaming system comprising:

a housing;

at least one processor;

at least one display device supported by the housing;

a plurality of input devices supported by the housing and including an acceptor; and at least one memory device storing a plurality of instructions which, when executed by the at least one processor, cause the at least one processor to:

establish a credit balance based at least in part on a monetary value associated with a physical item responsive to receipt, by the acceptor, of the physical item;

cause the at least one display device to display a designated symbol accumulation area including a plurality of designated symbol positions;

for a play of a game associated with a set of multiple symbols including a designated symbol:

place a wager responsive to receipt, by one of the input devices, of a wager input, the credit balance decreasable by the wager;

randomly determine and cause the at least one display device to display a plurality of the symbols of the set of symbols at a plurality of symbol display areas;

responsive to determining that the designated symbol is displayed at one of the symbol display areas, accumulate and cause the at least one display device to display the designated symbol at one of the designated symbol positions of the designated symbol accumulation area, wherein each accumulated designated symbol is associated with a designated period;

responsive to determining that an accumulated designated symbol is displayed at one of the designated symbol positions:

determine a modifier based on the accumulated designated symbols displayed at the designated symbol positions;

determine any awards based at least in part on the modifier and the symbols displayed at the symbol display areas;

cause the at least one display device to display any determined awards; and increase the credit balance based on any determined awards or modified awards;

before a next play of the game, for each of any accumulated designated symbols:

determine whether the designated period associated with said accumulated designated symbol has expired, responsive to determining that the designated period associated with said accumulated designated symbol has expired, cause the at least one display device to remove said accumulated designated symbol from the designated symbol position at which said accumulated designated symbol is displayed; and responsive to determining that the designated period associated with said accumulated designated symbol has not expired, cause the at least one display device to move said accumulated designated symbol to another one of the designated symbol positions; and initiate a payout associated with the credit balance responsive to receipt, via one of the input devices, of a cashout input.

2. The gaming system of claim 1, wherein the designated periods associated with at least two accumulated designated symbols overlap.

3. The gaming system of claim 1, wherein the designated periods associated with at least two accumulated designated symbols are the same.

4. The gaming system of claim 1, wherein the designated periods associated with any accumulated designated symbols are one of: (a) a designated period of time, and (b) a designated quantity of plays of the game.

5. The gaming system of claim 1, wherein the value of the modifier increases as a quantity of designated symbols included in the displayed symbols increases.

6. A method of operating a gaming system, said method comprising:

receiving, by an acceptor of the gaming system, a physical item associated with a monetary value;

establishing, by at least one processor, a credit balance based at least in part on the monetary value associated with the received physical item;

causing, by the at least one processor, at least one display device to display a designated symbol accumulation area including a plurality of designated symbol positions;

for a play of a game associated with a set of multiple symbols including a designated symbol:

placing, by the at least one processor, a wager following receipt, by an input device, of a wager input, the credit balance decreasable by the wager;

randomly determining, by the at least one processor, and causing, by the at least one processor, the at least one display device to display a plurality of the symbols of the set of symbols at a plurality of symbol display areas;

responsive to determining that the designated symbol is displayed at one of the symbol display areas, accumulating, by the at least one processor, and causing, by the at least one processor, the at least one display device to display the designated symbol at one of the designated symbol positions of the designated symbol accumulation area, wherein each accumulated designated symbol is associated with a designated period;

responsive to determining that an accumulated designated symbol is displayed at one of the designated symbol positions:

determining, by the at least one processor, a modifier based on the accumulated designated symbols displayed at the designated symbol positions;

determining, by the at least one processor, any awards based at least in part on the modifier and the symbols displayed at the symbol display areas;

causing, by the at least one processor, the at least one display device to display any determined awards; and increasing, by the at least one processor, the credit balance based on any determined awards or modified awards;

before a next play of the game, for each of any accumulated designated symbols:

determining, by the at least one processor, whether the designated period associated with said accumulated designated symbol has expired;

responsive to determining that the designated period associated with said accumulated designated symbol has expired, causing, by the at least one processor, the at least one display device to remove said accumulated designated symbol from the designated symbol position at which said accumulated designated symbol is displayed; and responsive to determining that the designated period associated with said accumulated designated symbol has not expired, causing, by the at least one processor, the at least one display device to move said accumulated designated symbol to another one of the designated symbol positions; and initiating, by the at least one processor, a payout associated with the credit balance following receipt, by one of the input devices, of a cashout input.

7. The method of claim 6, wherein the designated periods associated with at least two accumulated designated symbols overlap.

8. The method of claim 6, wherein the designated periods associated with at least two accumulated designated symbols are the same.

9. The method of claim 6, wherein the designated periods associated with any accumulated designated symbols are one of: (a) a designated period of time, and (b) a designated quantity of plays of the game.

10. The method of claim 9, which is provided through a data network.

11. The method of claim 10, wherein the data network is an internet.

12. The method of claim 6, wherein the value of the modifier increases as a quantity of designated symbols included in the displayed symbols increases.

13. A gaming system comprising:

at least one processor; and at least one memory device storing a plurality of instructions which, when executed by the at least one processor, cause the at least one processor to:

cause at least one display device to display a designated symbol accumulation area including a plurality of designated symbol positions;

for a play of a game associated with a set of multiple symbols including a designated symbol:

randomly determine and cause the at least one display device to display a plurality of the symbols of the set of symbols at a plurality of symbol display areas;

responsive to determining that the designated symbol is displayed at one of the symbol display areas, accumulate and cause the at least one display device to display the designated symbol at one of the designated symbol positions of the designated symbol accumulation area, wherein each accumulated designated symbol is associated with a designated period;

responsive to determining that an accumulated designated symbol is displayed at one of the designated symbol positions:

determine a modifier based on the accumulated designated symbols displayed at the designated symbol positions;

determine any awards based at least in part on the modifier and the symbols displayed at the symbol display areas; and cause the at least one display device to display any determined awards; and before a next play of the game, for each of any accumulated designated symbols:

determine whether the designated period associated with said accumulated designated symbol has expired;

responsive to determining that the designated period associated with said accumulated designated symbol has expired, cause the at least one display device to remove said accumulated designated symbol from the designated symbol position at which said accumulated designated symbol is displayed; and responsive to determining that the designated period associated with said accumulated designated symbol has not expired, cause the at least one display device to move said accumulated designated symbol to another one of the designated symbol positions.

14. The gaming system of claim 13, wherein the designated periods associated with at least two accumulated designated symbols overlap.

15. The gaming system of claim 13, wherein the designated periods associated with at least two accumulated designated symbols are the same.

16. The gaming system of claim 13, wherein the designated periods associated with any accumulated designated symbols are one of: (a) a designated period of time, and (b) a designated quantity of plays of the game.

17. The gaming system of claim 13, wherein the value of the modifier increases as a quantity of designated symbols included in the displayed symbols increases.

18. The gaming system of claim 13, wherein the display device is part of a mobile device.

* * * * *